US011406855B2

(12) United States Patent
DeYoung et al.

(10) Patent No.: US 11,406,855 B2
(45) Date of Patent: Aug. 9, 2022

(54) DYNAMIC FIRE SUPPRESSION SYSTEM AND METHOD I'HEREOF

(71) Applicant: USSC ACQUISITION CORP., Exton, PA (US)

(72) Inventors: Perry DeYoung, Ada, MI (US); Jeremiah Farrell, Lowell, MI (US)

(73) Assignee: USSC ACQUISITION CORP., Exton, PA (US)

( * ) Notice: Subject to any disclaimer, the term of this patent is extended or adjusted under 35 U.S.C. 154(b) by 0 days.

(21) Appl. No.: 16/240,660

(22) Filed: Jan. 4, 2019

(65) Prior Publication Data

US 2019/0209880 A1 Jul. 11, 2019

Related U.S. Application Data

(60) Provisional application No. 62/614,275, filed on Jan. 5, 2018.

(51) Int. Cl.

| | |
|---|---|
| ***A62C 13/64*** | (2006.01) |
| ***A62C 37/42*** | (2006.01) |
| ***A62C 37/46*** | (2006.01) |
| ***A62C 37/40*** | (2006.01) |
| ***A62C 35/02*** | (2006.01) |
| ***A62C 37/50*** | (2006.01) |
| ***A62C 35/13*** | (2006.01) |
| ***A62C 13/00*** | (2006.01) |
| ***A62C 37/36*** | (2006.01) |
| ***A62C 37/11*** | (2006.01) |

(52) U.S. Cl.

CPC ..... *A62C 13/64* (2013.01); *A62C 13/003* (2013.01); *A62C 35/023* (2013.01); *A62C 35/13* (2013.01); *A62C 37/04* (2013.01); *A62C 37/11* (2013.01); *A62C 37/40* (2013.01); *A62C 37/42* (2013.01); *A62C 37/46* (2013.01); *A62C 37/50* (2013.01)

(58) Field of Classification Search

CPC ..... A62C 13/64; A62C 13/003; A62C 35/023; A62C 35/13; A62C 37/04; A62C 37/11; A62C 37/40; A62C 37/42; A62C 37/46; A62C 37/50

USPC ..... 169/60, 61, 30

See application file for complete search history.

(56) References Cited

U.S. PATENT DOCUMENTS 6,164,383 A * 12/2000 Thomas ..... A62C 3/07 169/26

* cited by examiner

*Primary Examiner* — Christopher S Kim

(74) *Attorney, Agent, or Firm* — Faegre Drinker Biddle & Reath LLP

(57) ABSTRACT

A fire suppression system having a first triggering mechanism capable of being remotely triggered in response to a fire condition and a second manual triggering mechanism. More particularly, the fire extinguisher includes a valve for a fire extinguisher capable of manual and automatic operation. The system further includes a mechanism to notify of inoperable local status. During automatic operation, the system can be being triggered by a control panel in electrical communication, such as in response to a signal from smoke detectors. This system may also be manually triggered or in response to a temperature threshold sensor or other sensors. The valve includes an actuator that provides a separate area to place a safety pin for storing securely, and which provides feedback to the control system that the safety pin is properly stored and therefore, the fire extinguisher is active.

32 Claims, 23 Drawing Sheets

DYNAMIC FIRE SUPPRESSION SYSTEM AND METHOD I'HEREOF

CROSS-REFERENCE TO RELATED APPLICATIONS

This application claims the benefit of and priority to U.S. Provisional Patent Application Ser. No. 62/614,275 filed on Jan. 5, 2018, the entire disclosure of which is hereby incorporated by reference.

BACKGROUND OF THE INVENTION

1. Field of the Invention

The invention relates generally to a fire suppression system, fire extinguishers for use in the fire suppression system, methods of releasing extinguisher fluid, and more particularly to actuators used for discharging fluid or gas in a fire extinguisher.

2. Related Art

Fire suppression systems are common in many facilities and many building codes and local ordinances require a fire suppression system. In addition, owners or tenants of every type of facility including industrial, commercial, and residential facilities and buildings find fire suppression systems desirable and useful, even if building codes or ordinances may not require a fire suppression system. For example, it may be desirable to prevent fires or address areas of special concern, which may widely vary depending on the type of building or even the type of contents of the building. For example, a fire suppression system may be used to protect important artwork, server rooms, areas where flammable materials and chemicals are stored, or even historic buildings to prevent rebuilding and/or loss of contents from a fire. In addition, fire suppression systems may be configured with special agents, specifically configured to minimize property damage and may suppress a fire earlier than the arrival of a fire department using water. In fact, according to the Fire Equipment Manufacturers Association, fires extinguished in the early stages substantially reduce loss of life and direct property damage by over 90%.

Fire suppression systems included in facilities and buildings generally may be divided into two types, engineered and pre-engineered, although some fire suppression systems may include characteristics of each type of fire suppression system, depending on the facility and operator's needs. Engineered fire suppression systems are typically design specific or building specific and are generally expensive to design and install as they are customized for each location. Stated another way, an engineered system is complex to design and install. As such, engineered fire suppression systems are generally limited to larger facilities, or to fulfill specialized needs that cannot be addressed by pre-engineered systems. In comparison pre-engineered fire suppression systems use pre-designed elements to eliminate the need for specialized engineering design work and expensive customized installation, beyond the original product design.

While "bottle" fire extinguishers have improved over the years, these fire extinguishers are still basically a tank of pressurized contents held in place by a valve until needed. In operation, the valve is opened and the pressurized content is expelled through a discharge nozzle. The contents of a fire extinguisher may widely vary, include a gas such as carbon dioxide ($CO_2$) or nitrogen, a powder such as potassium bicarbonate ($KHCO_3$), a liquid such as water, an evaporating fluorocarbon, or any combination thereof.

The valve of a typical bottle fire extinguisher, whether handheld or a fixed extinguisher included in a pre-engineered system, is typically in a locked or closed state when the fire extinguisher is stored so that the contents cannot, accidently or through human error, discharge. These valves include an actuator allowing the valve to be switched between the closed state and an open state wherein the stored contents can freely exit the nozzle. Portable handheld or similar fire extinguishers are commonly hung on the wall or placed in accessible cavities for manual fighting of spot fires in residential uses or smaller office, commercial, or industrial facilities and use a manual valve, such as a valve built into the handle that is locked with a safety pin until the fire extinguisher is needed. The safety pin prevents unintended or non-permitted discharge during transportation or before intended use. These fire extinguishers are commonly transported to the scene of the fire and manually actuated, such as by squeezing a handle. These portable fire extinguishers are generally of limited use because they require personnel to be present at the location of the fire when it occurs, and to be ready, willing, able, and trained in the proper use to quickly put out a fire before it reaches a size that a portable handheld fire extinguisher would have little effect or the person activating it cannot get safely close enough to the source of the fire. As such, handheld or portable fire extinguishers have limited utility in facilities, and larger facilities or specialized facilities need a full fire suppression system with more permanent and automatically actuating fire suppression systems, such as the above described engineered and pre-engineered fire suppression systems. Of course, even if a pre-engineered suppression system is installed, portable hand held fire extinguishers are typically also used in the facility.

In view of the issues associated with handheld portable fire extinguishers, many fire suppression systems are built into the building or other structure being protected. In addition, under building codes and local ordinances, most buildings also require some type of automatic fire suppression system when the building reaches a certain size, has a freespan over a certain length, or has certain type of items stored or activities at the facility. Water sprinklers are by far the most common type of fixed fire suppression system because they are relatively inexpensive, highly reliable and safe for people. But water damage cannot always be tolerated such as in server rooms and certain types of facilities. Thus sprinkler systems are sometimes ineffective, and they may be impractical where weight and space are limited, or where the water supply or volume of water is limited, or in unconditioned or refrigerated spaces.

By including fixed fire extinguishing units at various strategic points that are automatically controlled, in addition to an optimal manual control, the usability increases. As such, many fixed fire extinguishers in pre-engineered systems, where sprinkling is undesirable or impractical now use various clean agents, capable of putting out many types of fires and are generally known as a ABC or and AB or and AC fire extinguisher, with Class A for wood, paper and trash, Class B for liquids and gases and Class C for energized electrical sources. While many pre-engineered fire suppression systems adopt the technology from handheld portable fire extinguishers into fixed bottled fire extinguishers that are part of a pre-engineered fires suppression system that is centrally actuated, there are issues that need to be addressed. Some of these issues include how to disperse the agent in a desirable fashion, inability to manually actuate if they are connected to an automatic fire suppression system, and even more problematic, they can be subject to installation errors that make them inoperable or fail to discharge when desired, especially due to failure to remove the safety pin that prevents discharge during transportation and installation.

These pre-engineered systems have been known to incorporate temperature dependent release actuators configured to discharge based on a temperature reading associated with a fire. In these systems, when the ambient temperature reaches a threshold temperature the actuator opens the valve and the pressurized contents automatically and completely discharge all the fluid from the tank. By placing these extinguishers such that the discharge nozzles are oriented towards machinery, electrical components, or any assemblies that are known to create fire risks or need to be protected in the event of a fire, these automatic fire extinguishers can effectively reduce fire damage and hopefully prevent spreading of the fire or even put out the fire before it becomes a substantial risk. It should be noted that the pressure release also provides a cooling effect that often extinguishes the fire completely.

However, all of the aforementioned systems suffer from the disadvantage of only having one actuator, either automatic or temperature dependent, and are thus limited by criteria from which the valve can switch to the open state. As such, they are not capable of being manually activated, except at the remote control panel or allowing for a combination of automatic control by a remote control panel in addition to temperature triggered, or especially not capable of all three methods of release or additional methods of release.

Another problem with these individual fire extinguishers being centrally actuated is monitoring the status of the fire extinguisher and more specifically if it was properly installed such that it is configured to operate. As stated above, most of these bottle fire extinguishers used in pre-engineered systems include some type of lockout device, such as a safety pin, to prevent accidental discharge during installation and maintenance. However, many times installers forget to remove the safety pin or lockout device once installed and while the control panel for the fire suppression system shows that each fire extinguisher connected to the control panel in the pre-engineered system is connected properly, it failed to show if the safety pin was removed or the lock-out device was disabled to allow operation of the valve. In certain circumstances, a person thinking that they are being helpful may put the pin back in the system causing it to not operate at a critical time and the operator would have no idea that device is locked out from operation.

SUMMARY OF THE INVENTION

The present invention relates to a pre-engineered fire suppression system. Specifically, a fire suppression system that may be used in facilities and areas where water sprinklers are undesirable, wherein specialized spot coverage is desirable, a fire extinguisher capable of multiple methods of activation. For example, a fire extinguisher capable of multiple manual and automatic operations, and more particularly to a valve for a fire extinguisher capable of manual and automatic operation, and more particularly yet a fire extinguisher and valve, with a mechanism to notify of inoperable local status. More specifically the present invention may allow for at least two methods of automatic operation, the first being triggered by a control panel in electrical communication, such as in response to a signal from smoke detectors, and the second being triggered either manually or temperature triggered. The manually triggering may be done locally at each unit or the multiple extinguishers at a manual pull box. The present invention provides a fire suppression system comprising at least one fire extinguishing unit or device, with at least one actuator that senses presence of a fire or certain activation criteria, including remotely through a control panel or by temperature local to the fire extinguishing unit. While typically a plurality of individual fire extinguishers are used in combination with a control panel and a plurality of sensors to report activation criteria in different parts of the facility or even different activation criteria to a control panel, to trigger the individual units, the sensors could be individually directly wired with direct triggering without a control panel. The system may include not only temperature sensors, smoke sensors, pressure sensors, oxygen level sensors, but a plurality of actuators and sensors, in any combination, that respond to different criteria, such as any known or future developed method of sensing a fire.

The fire extinguisher, while it could be used singularly, is expected to typically be part of a larger system and be in electrical communication with a control system. The control system may control one or more fire extinguishers with the actuating device or valve of the present invention, and could also control other types of fire extinguishers and systems. As such, the fire extinguishers of the present invention provide significant advantages because they may be integrated into existing control systems as replacements or supplements, even as supplements to longer engineered systems such as for spot control of sensitive areas. The fire extinguishing units being in electrical communication with the control system allows data regarding environmental conditions to be transmitted from the fire extinguishing unit to a CPU. The CPU may be connected to a monitor assembly or another feedback device that translates the data into a readable or understandable format regarding the status of each fire extinguishing unit. The fire extinguishing units may be configured to discharge through manual operation of the supervisor either remotely or locally, automatic operation based on threshold environmental readings, or some combination of the two. Moreover, the CPU can be programmed with commands which provide optimum fire extinguishing unit discharge, such as the rate of discharge, based on certain environmental conditions.

One substantial advantage of the present invention, in particular is located in the actuation device or actuating portion of the fire extinguisher which provides a safety pin inserted into the valve, allowing for safe transport, installation, and servicing, but yet provides feedback to the control panel of any unit where the safety pin is not inserted into a keeper. More specifically, instead of monitoring the removal or presence of the safety pin in the lockout position, the actuator provides a separate area to place the safety pin for storing securely, and provides feedback to the control system that the safety pin is properly stored and therefore, the fire extinguisher is active. The safety pin must be removed for operation, and the system reports the operational condition of each fire extinguisher back to the control system. More specifically, the safety pin upon removal from the locking hole is reinserted into a separate opening, which actuates the communication to the control system regarding status. As such, proper installation of each fire extinguisher may easily and cost effectively be determined.

The present invention is directed generally to a pre-engineered fire suppression system configured to release pressurized material to extinguish fires, generally including a control panel, a sensor capable of detecting a fire condition and in communication with the control panel, at least one fire extinguishing unit in communication with the control panel and including an activation device coupled to a tank capable of holding the pressurized material and wherein the activation device includes a first triggering mechanism capable of being triggered by the control panel and a second manual triggering mechanism, and a lock pin status sensor in communication with the control panel.

The activation device may include a valve body portion having a lock pin receiving recess and an activation portion, having a lock pin retention mechanism. The lock pin retention mechanism may include the lock pin status sensor in communication with the control panel. The lock pin retention mechanism may include a magnet configured to magnetize a lock pin when the lock pin is received in the lock pin retention mechanism. The lock pin status sensor may be a reed switch, triggered when the lock pin is magnetized by the magnet. The magnet then not only secures the lock pin in the recess but the lock pin status sensor also communicates a ready and active signal upon stowing of the lock pin in the lock pin retention mechanism to the control panel. The lock pin status sensor communicates a fault signal to the control panel when no lock pin is stowed in the lock pin retention mechanism. The lock pin recess on the valve portion upon receiving a lock pin is configured to prevent releasing of the pressurized material from the tank.

The present invention may include a third release mechanism or even additional release mechanisms. An exemplary additional release mechanism is a glycerin bulb configured to shatter upon reaching a set temperature condition.

The actuation device may further include an activation portion and a valve portion and a lever mechanism extending between the activation portion and the valve portion and wherein the valve portion includes a valve body and a valve movable between an open position and a closed position relative to the valve body. The lever mechanism includes a valve lever coupled to an actuation lever. The valve lever is constrained to movement substantially within a plane by a slot in the valve body.

The valve is held in a closed position by a breakable pin held in compression between by the valve body. The breakable material may be formed of any material capable of providing the desired function, however in the illustrated figures it is a glass pin or a glass bulb without glycerin or a glass pin or bulb filled with glycerin. The breakable pin is held in compression between a threaded adjustment and the valve. The valve lever is coupled to the breakable pin, such as by the illustrated loop, wherein the valve lever includes an interlink hole and a lock pin hole between the interlink hole and the loop. The actuation lever includes an activation arm and a link arm and wherein the link arm includes a link slot and the valve lever is coupled to the link arm to allow the valve lever to have a limited amount of movement relative to the link arm on the actuation lever. The loop pivots on the breakable pin until the breakable pin breaks when the actuation lever exerts a force on the valve lever. The actuation lever is substantially constrained to planer movement by a slot in the activation portion.

The actuation lever is coupled to the second manual triggering mechanism. The second manual triggering mechanism is a pull loop on the actuation lever, or a wire cable or a pull cable coupled to the actuation lever. The activation portion includes an activation body having a recess configured to hold an end of the pull cable. The first triggering mechanism is a metron actuator. The metron actuator includes an extendable pin and a base and when triggered the extendable pin pierces the base and applies a force to the actuation arm on the actuation lever, which in turn applies a force to the valve lever breaking the breakable pin. The sensor is a smoke detector and the control panel is in electrical communication with a plug on the actuation portion of the fire extinguishing unit.

A test device may be sued to test connection to control panel.

In another exemplary embodiment, the pre-engineered fire suppression system is configured to release pressurized material to extinguish fires and includes a control panel, a sensor capable of detecting a fire condition and in communication with the control panel, at least one fire extinguishing unit in communication with the control panel and including an activation device coupled to a tank capable of holding the pressurized material and wherein the activation device includes a first triggering mechanism capable of being triggered by the control panel and a second manual triggering mechanism, and a breakable pin held in compression and wherein the breakable pin is configured to be broken upon the first triggering mechanism being triggered. The activation device includes a valve body portion having a lock pin receiving recess and an activation portion, having a lock pin retention mechanism, and wherein a lock pin status sensor in communication with the control panel is configured to communicate the presence or absence of a lock pin in the lock pin retention mechanism. The lock pin retention mechanism includes a magnet configured to magnetize the lock pin when the lock pin is received in the lock pin retention mechanism and wherein the lock pin status sensor is a reed switch, triggered when the lock pin is magnetized by the magnet. The lock pin recess on the valve portion upon receiving a lock pin is configured to prevent releasing of the pressurized material from the tank.

The system may further include an activation portion and a valve portion and a lever mechanism extending between the activation portion and the valve portion and wherein the valve portion includes a valve body and a valve movable between a closed position and an position relative to the valve body wherein in a ready state, the valve is held in a closed position by a breakable pin held in compression between by the valve body, and in an active state, the breakable pin is broken allowing the valve to open and discharge the pressurized material from the tank.

The system may further include an activation portion and a valve portion and a lever mechanism extending between the activation portion and wherein the lever mechanism includes a valve lever coupled to an actuation lever, and wherein the valve lever includes a valve lever hole capable of being aligned with a lock pin receiving recess on the valve body and wherein a lock pin is placed in the aligned lock pin receiving recess and the valve lever hole in a safe state.

The valve lever is constrained to movement substantially within a plane by a slot in the valve body and the actuation lever is constrained to movement substantially within the plane by a slot in the actuation portion.

The system may further include an activation portion and a valve portion and a lever mechanism extending between the activation portion wherein the valve is held in a closed position by a breakable pin held in compression between by the valve portion and wherein the valve lever is coupled to the breakable pin. The valve lever is coupled to the breakable pin with a loop encircling the breakable pin. The valve lever includes an interlink hole and a lock pin hole between the interlink hole and the loop and wherein the actuation lever includes an activation arm and a link arm and wherein the link arm includes a link slot and the valve lever is coupled to the link arm to allow the valve lever to have a limited amount of movement relative to the link arm on the actuation lever.

Upon the triggering of at least one of the triggering mechanisms, the actuation lever is configured to apply force to the valve arm to cause the loop to rotate relative to the breakable pin as well as move axially away from the breakable pin until the breakable pin breaks. The second manual triggering mechanism is at least one of a pull loop on the actuation lever, a pull cable coupled to the actuation lever, or a manual release box coupled to the actuation lever with a wire cable. The first triggering mechanism is a metron actuator having an extendable pin and a base and when the metron actuator is triggered the extendable pin pierces the base and applies a force to the actuation arm on the actuation lever, which in turn applies a force to the valve lever breaking the breakable pin. The sensor is a smoke detector and the control panel is in electrical communication with a plug on the actuation portion of the fire extinguishing unit. The first triggering mechanism is a single use triggering mechanism.

The pre-engineered fire suppression system may be configured to release pressurized material to extinguish fires, and includes a control panel, a sensor capable of detecting a fire condition and in communication with the control panel, at least one fire extinguishing unit in communication with the control panel and including an activation device coupled to a tank capable of holding the pressurized material and wherein the activation device includes a first triggering mechanism capable of being triggered by the control panel and a second manual triggering mechanism, a lock pin status sensor in communication with the control panel, a breakable pin held in compression and wherein the breakable pin is configured to be broken upon the first triggering mechanism being triggered, and an activation portion and a valve portion and a lever mechanism extending between the activation portion and wherein the lever mechanism includes a valve lever coupled to an actuation lever, and wherein the valve lever includes a valve lever hole capable of being aligned with a lock pin receiving recess on the valve portion and wherein a lock pin is placed in the aligned lock pin receiving recess and the valve lever hole in a safe state.

The valve lever is constrained to movement substantially within a plane by a slot in the valve body and the actuation lever is constrained to movement substantially within the plane by a slot in the actuation portion. The valve portion is held in a closed position by the breakable pin held in compression between by the valve portion and wherein the valve lever is coupled to the breakable pin with a loop at least partially encircling the breakable pin. The valve lever includes an interlink hole and a lock pin hole between the interlink hole and the loop and wherein the actuation lever includes an activation arm and a link arm and wherein the link arm includes a link slot and the valve lever is coupled to the link arm with an interlink to allow the valve lever to have a limited amount of movement relative to the link arm on the actuation lever.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE EXAMPLE EMBODIMENTS

Figure 1:
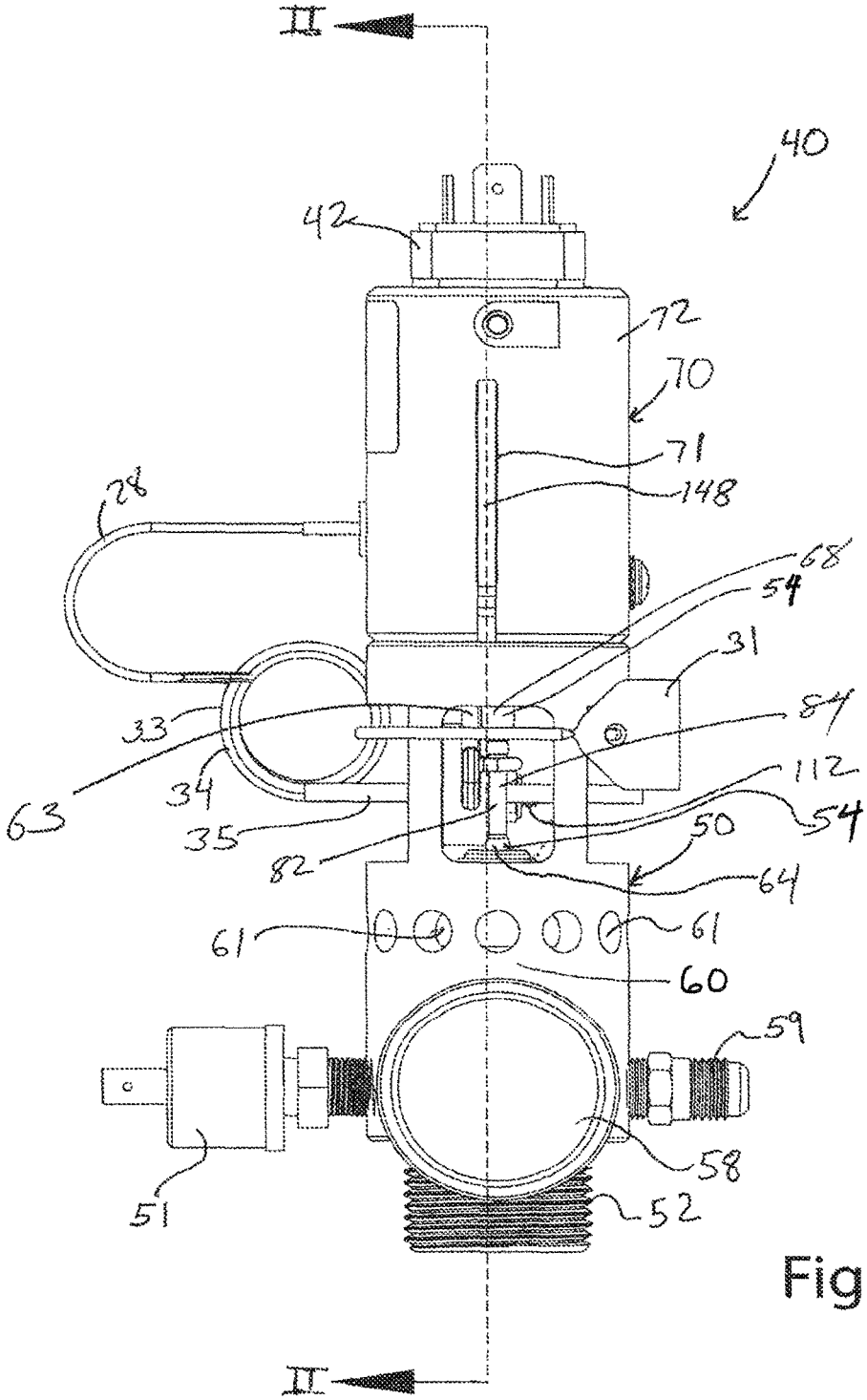
FIG. 1 is a front view of the actuation device utilized in a fire extinguishing unit in a closed and locked state.

The invention provides a pre-engineered dynamic fire suppression system 20 that includes at least one fire extinguishing unit or device 30 in communication with a control panel 150 and at least one sensor 180 in communication with the control panel 18. Each fire extinguishing unit 30 includes an actuation device 40, having an actuation portion 90 and a valve portion 50, and a tank 32 capable of containing pressurized contents or material.

The tank 32 may be any type of tank commonly used to hold pressurized contents in the fire extinguishing industry. The size may vary, and commonly used in fire suppression systems are 25 cubic foot to 1500 cubic foot tanks, depending on numerous factors determined when designing the desired system 20. The contents of the tank 32 of the subject invention could be one or more fluids, dry chemicals, or the like. For a non-exhaustive list, these contents could include pressurized water, carbon dioxide, dry chemicals, ammonium phosphate, sodium bicarbonate, compounds containing potassium, and various types of chemical foams or clean agents. Each fire extinguishing unit 30 does not have to contain the same contents, and the contents or pressurized materials may vary depending on location, environmental factors, types of flammable materials in the facility or other considerations.

Figure 2:
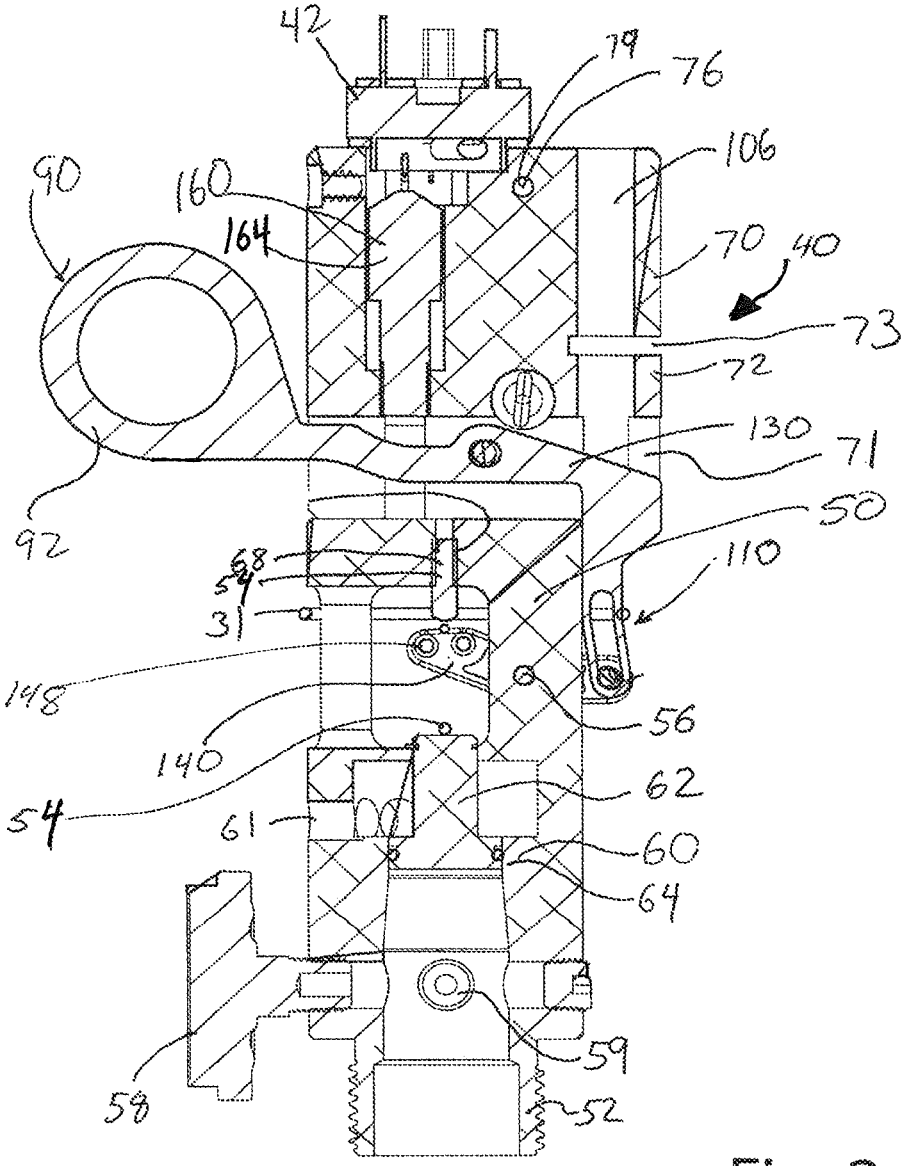
FIG. 2 is cross-sectional view of the actuation device in FIG. 1 along lines II-II in a closed and locked state.
Figure 3:
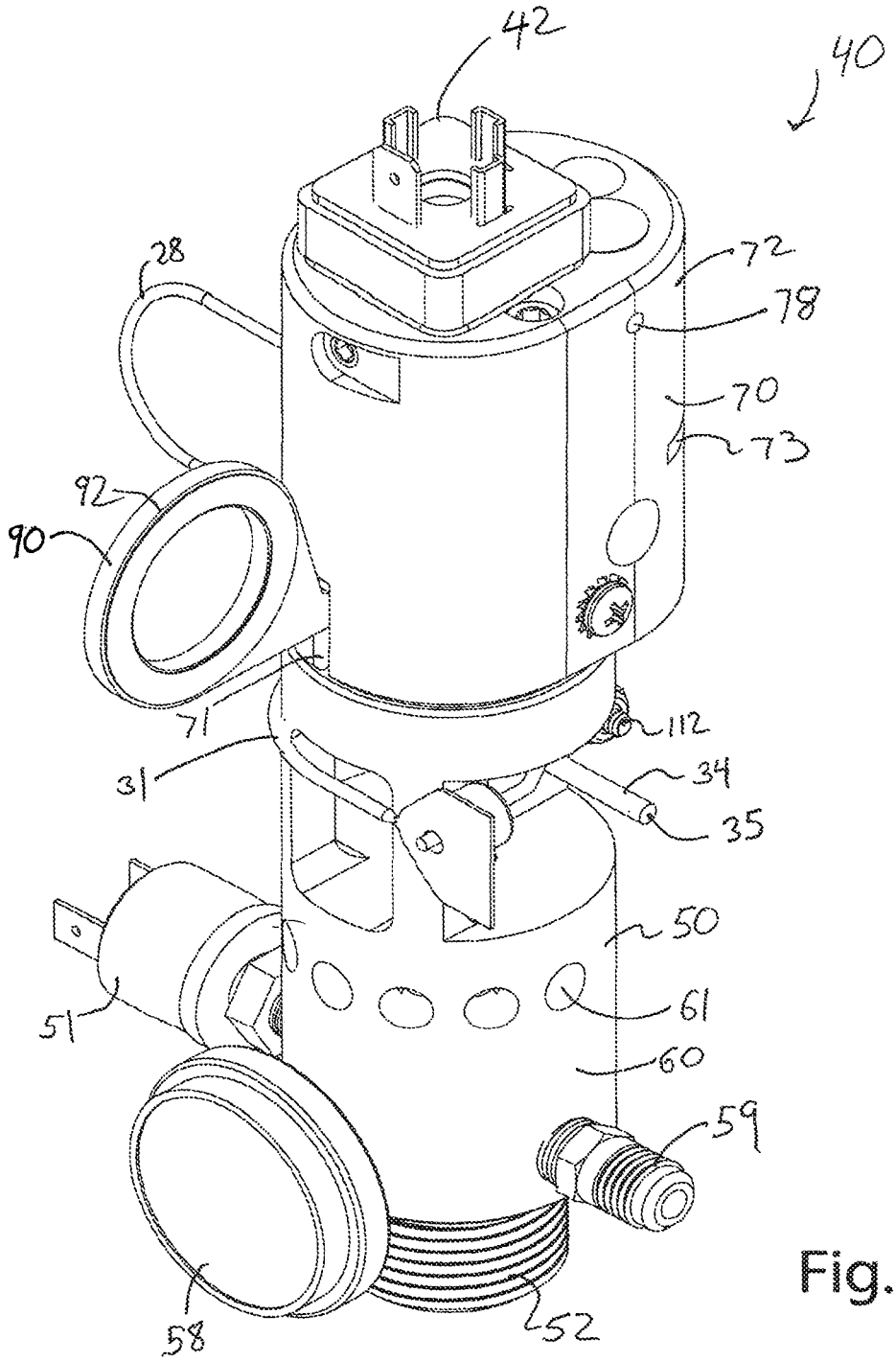
FIG. 3 is a front perspective view of an actuation device in a closed and locked state.
Figure 4:
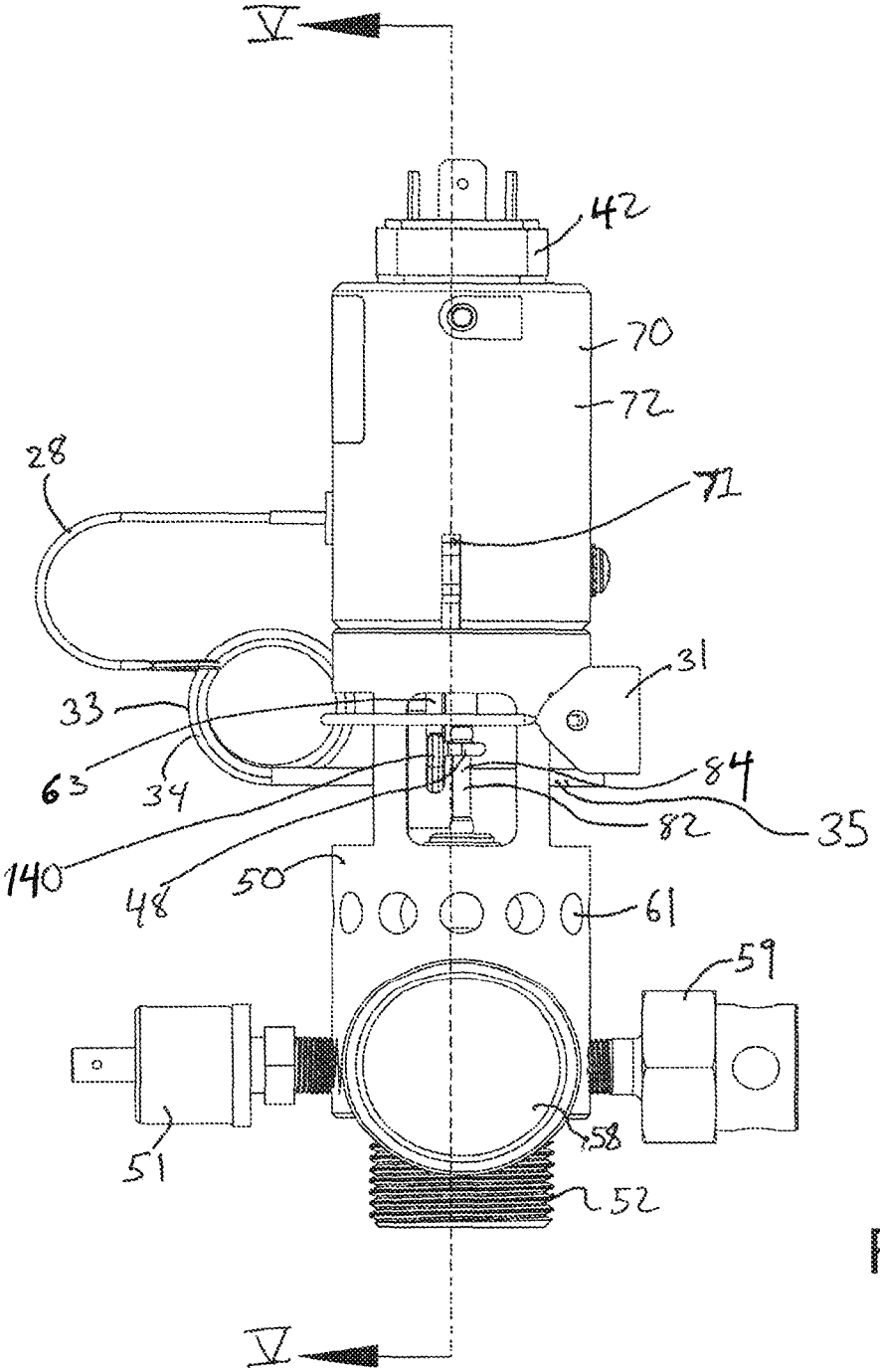
FIG. 4 is a front view of an actuation device in a closed and locked state.
Figure 5:
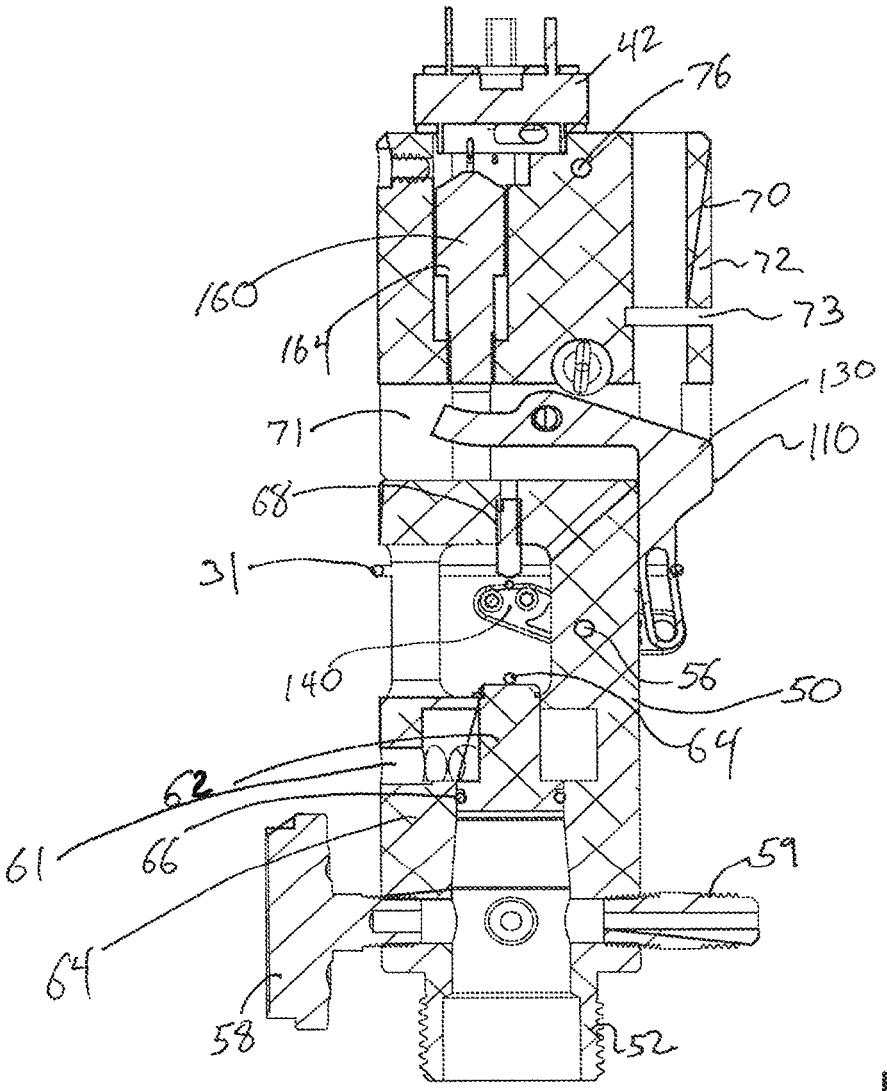
FIG. 5 is a cross-sectional view of the activation device in FIG. 4 along lines B-B in a closed and locked state.
Figure 6:
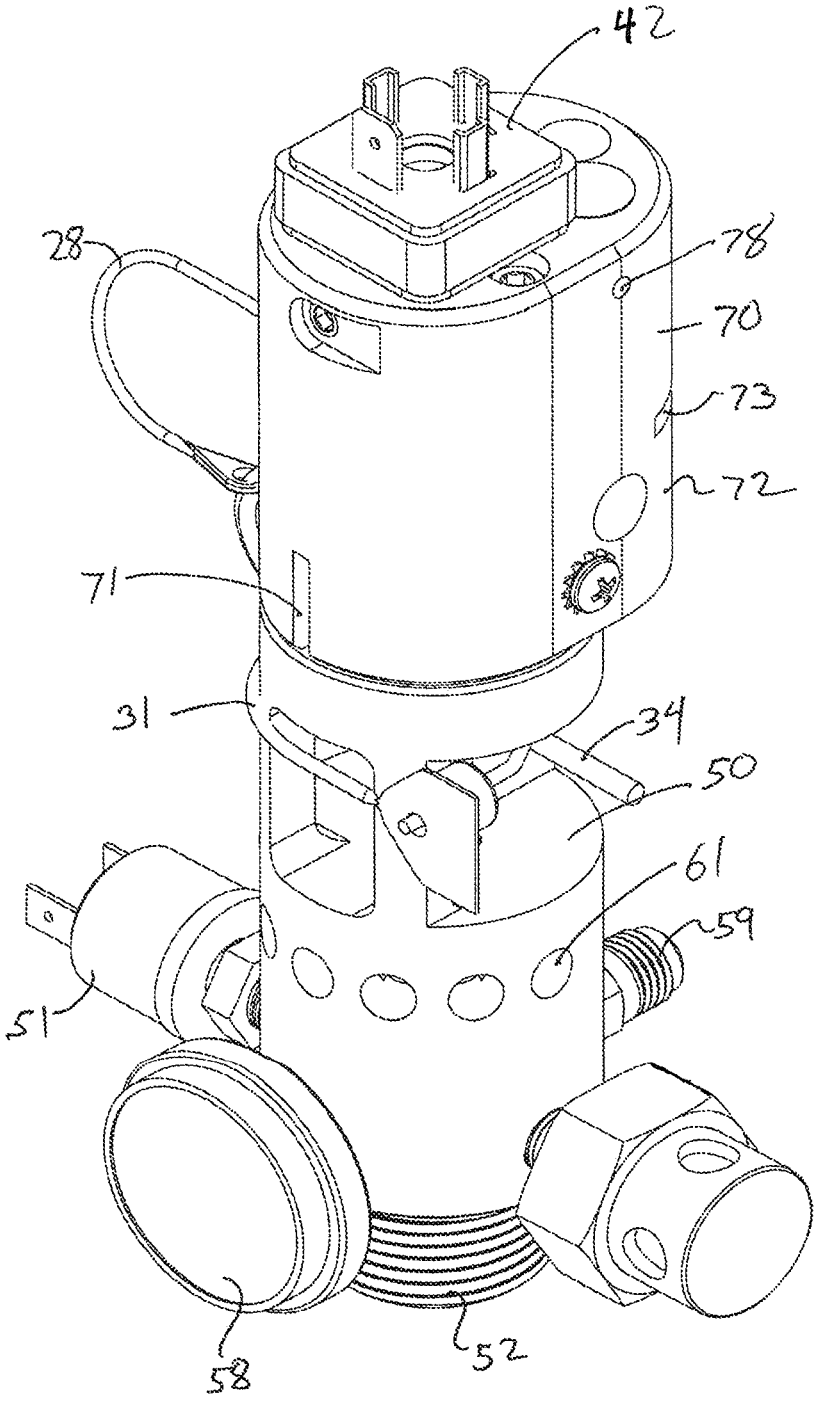
FIG. 6 is a front perspective view of an actuation device.
Figure 7:
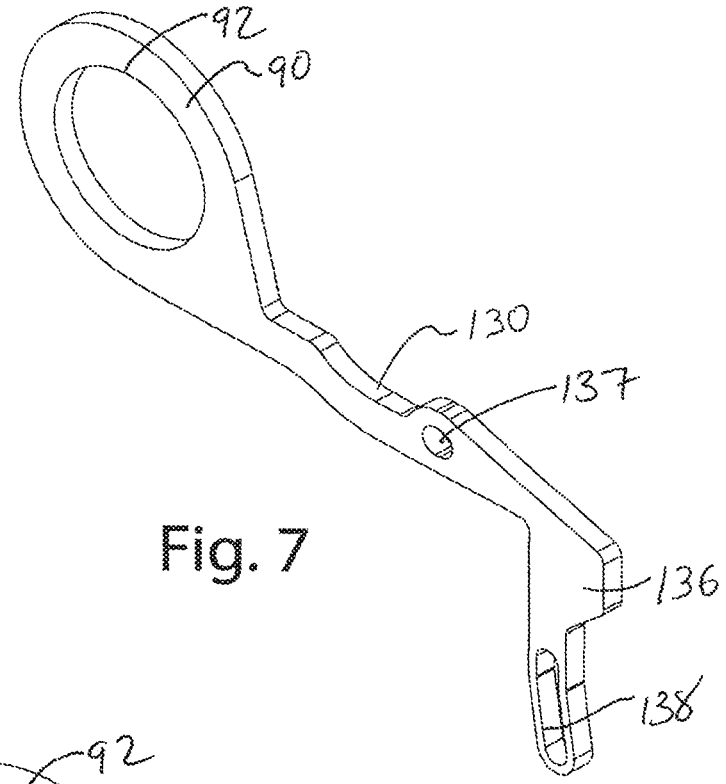
FIG. 7 is a perspective view of the actuation lever with pull loop.
Figure 8:
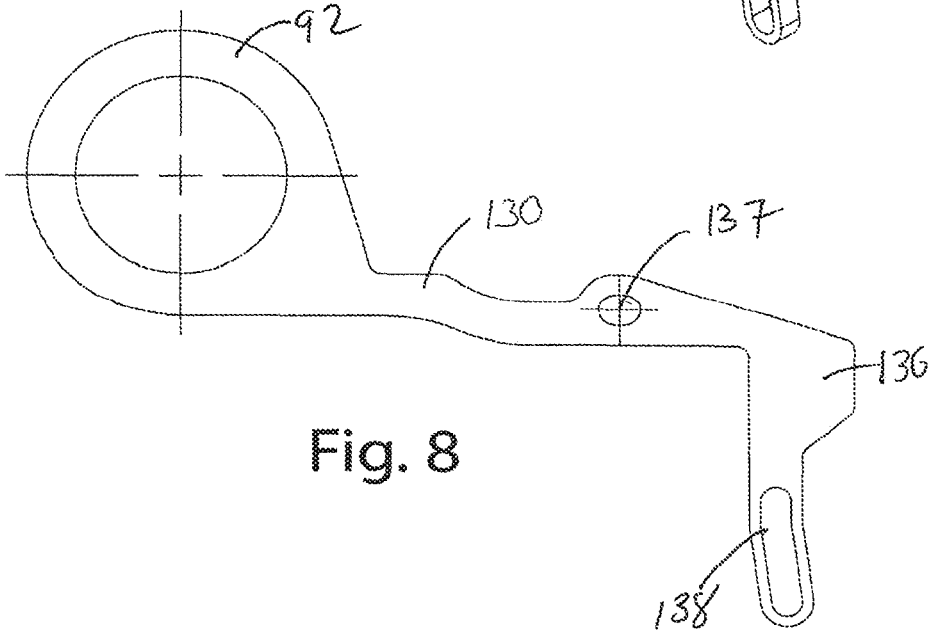
FIG. 8 is a front view of the actuation lever in FIG. 7.
Figure 9:
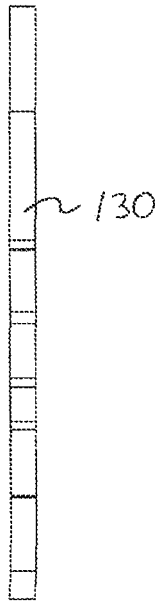
FIG. 9 is a top view of the actuation lever in FIG. 7.
Figure 10:
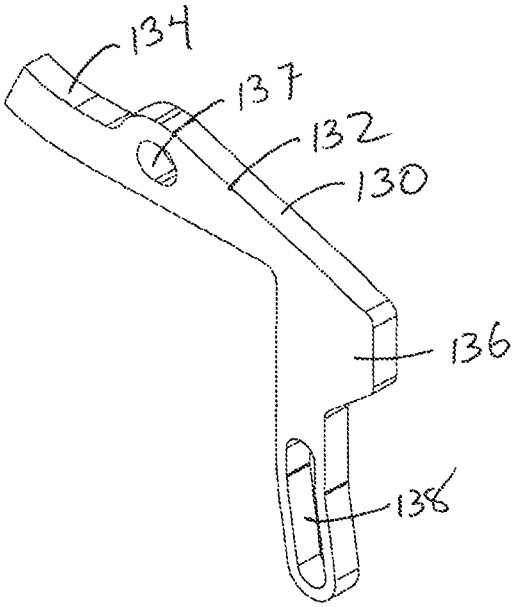
FIG. 10 is a perspective view of an actuation lever without a pull loop.
Figure 11:
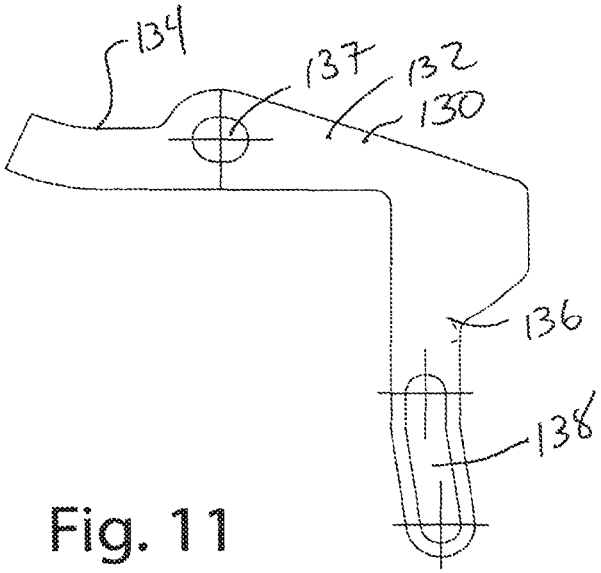
FIG. 11 is a front view of the actuation lever in FIG. 10.
Figure 12:
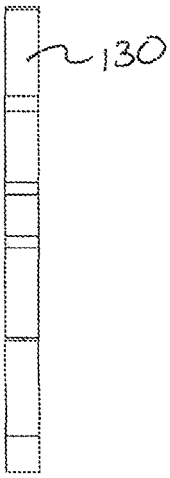
FIG. 12 is a top view of the actuation lever in FIG. 10.

The actuation device 40 of the present invention is unique in allowing manual and automatic operational control from the control panel 150 as well as in some embodiments manual control on or proximate to the unit 30 or even one or more separate manual release stations that are not part of the control panel 150. The actuation device 40 includes a discharge nozzle or ejection ports 61 separated from the pressurized contents in the tank 32 by a valve 62 in the valve body portion 60 of the valve portion 50. The valve 62 has an open state, wherein pressure is relieved or released from the tank 32 and the contents are ejected through and oriented by the discharge nozzle 61. The valve 62 also has a closed state, as illustrated in FIG. 2 wherein the valve 62 impermeably seals the pressurized contents in the tank 32 in a ready operational state. The actuation device 40 also includes at least one actuator or triggering mechanisms 161, preferably at least two actuators or triggering mechanisms, represented by the pull loop 148 and triggered actuator 160, as best illustrated in FIG. 5, which respond to a plurality of criteria. Other triggering mechanisms may be used.

The actuation device 40 is in communication with the control panel 150 and may be in electrical communication through an electrical connection 8 between the triggered actuator 160, and may include other electrical connections or communications with the control panel, for receiving commands from and for transmitting data to control system which may include a central processing unit (CPU) in the control panel 150. As stated above, the control panel 150 is in communication with sensors 180. The extinguishing unit 30 may further include a pressure reading or using a pressure connector 51 that may be communicated through the electrical connection 8 or other mechanism to the control panel 150. As such, the system 20 may qualify as an A/C system by electrically releasing via an activation of a smoke detector or heat detector, such as the sensor 180, in communication with the control panel 150, informing the control panel 150 to fire or trigger the unit 30.

Figure 25:
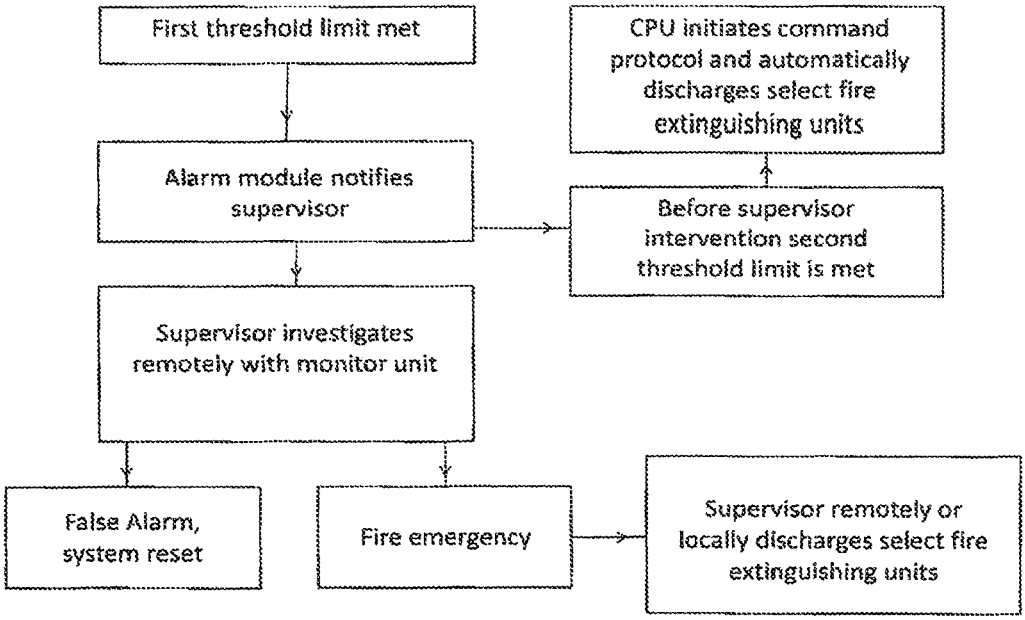
FIG. 25 is a flow chart illustrating an exemplary process flow.
Figure 26:
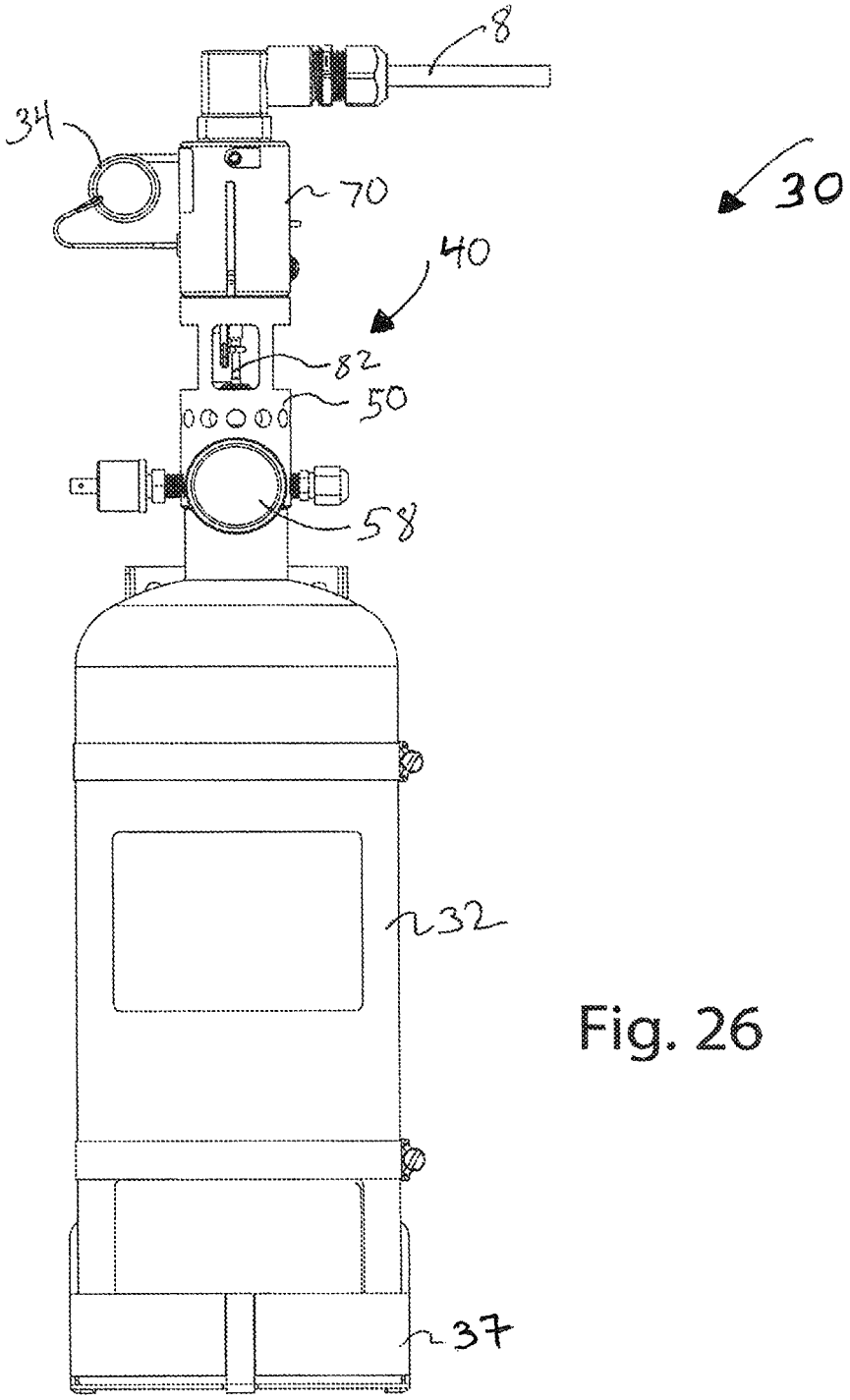
FIG. 26 is a front view of a fire extinguishing unit mounted to a wall in a ready state with the lock pin secured in the lock pin retention mechanism on the actuation portion.
Figure 27A:
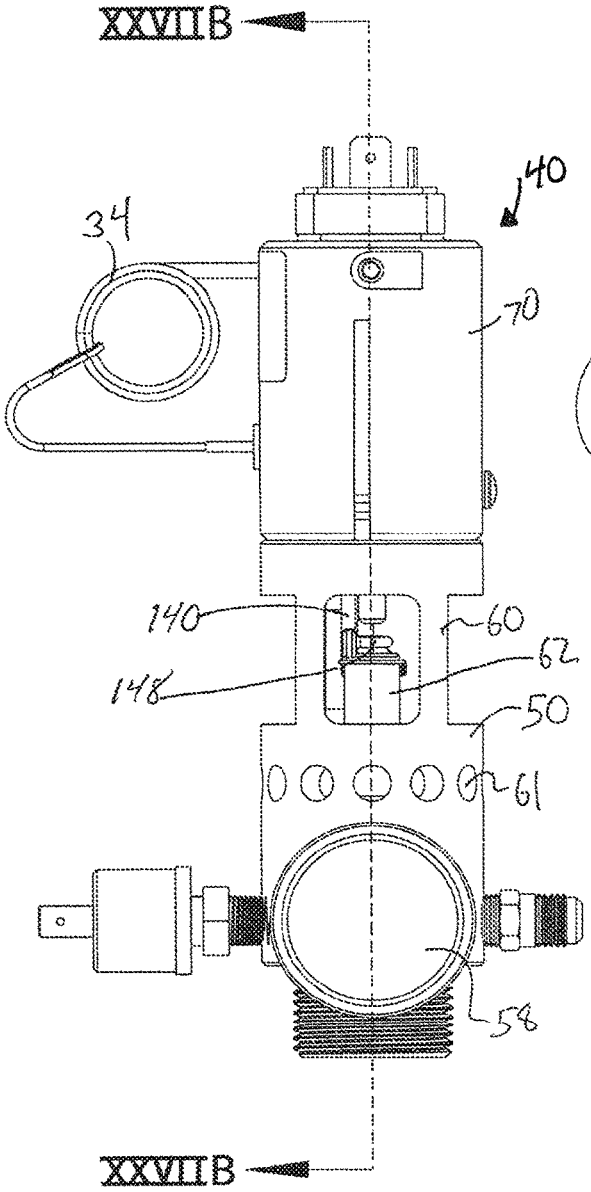
FIG. 27A is a front view of an actuation device in a discharging state with the glycerin bulb broken and dislodged from experiencing a set temperature and the valve being pushed upward as the pressurized materials are discharged.
Figure 27B:
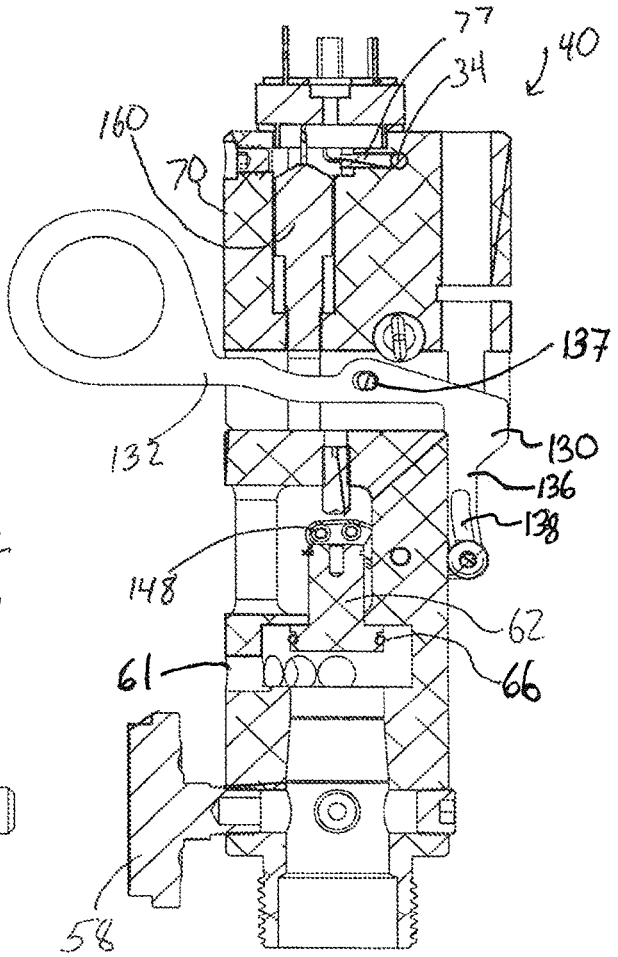
FIG. 27B is a cross sectional view of the activation device in FIG. 27A, taken along lines XXVIIB-XXVIIB upon activation due to bulb breaking from temperature threshold being reached.
Figure 28A:
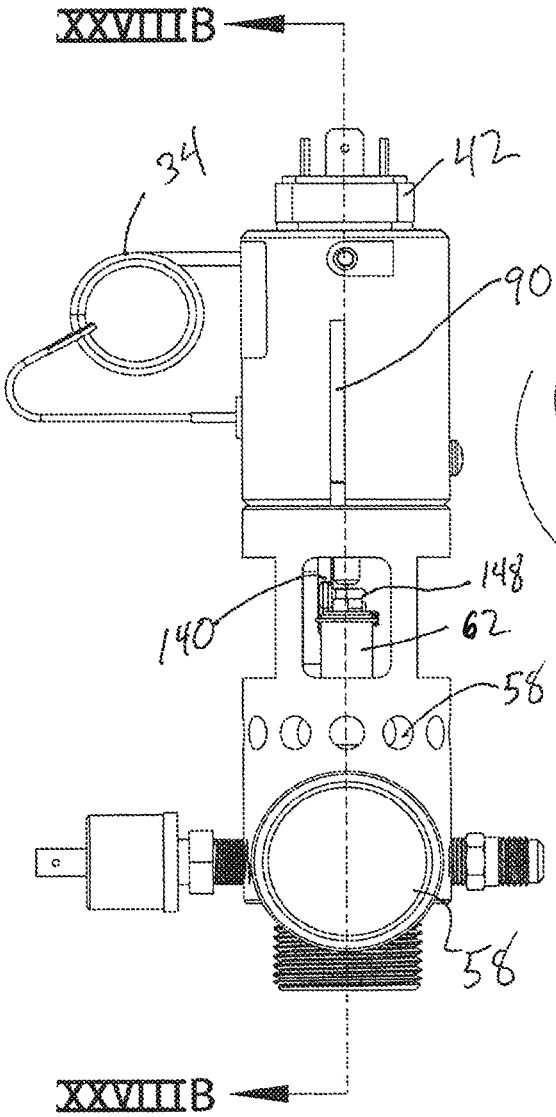
FIG. 28A is a front view of an actuation device in a discharging state with the breakable pin being broken and dislodged from movement of the actuation lever and the valve being pushed upward as the pressurized materials are discharged.
Figure 28B:
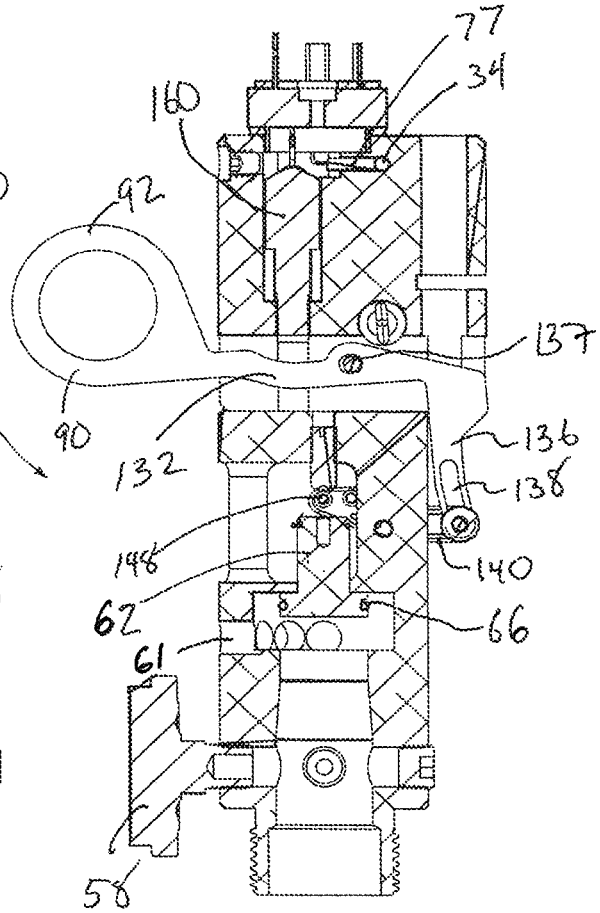
FIG. 28B is a cross sectional view of the activation device in FIG. 28A, taken along lines XXVIIIB-XXVIIIB upon activation from being manually triggered with the pull loop.
Figure 29A:
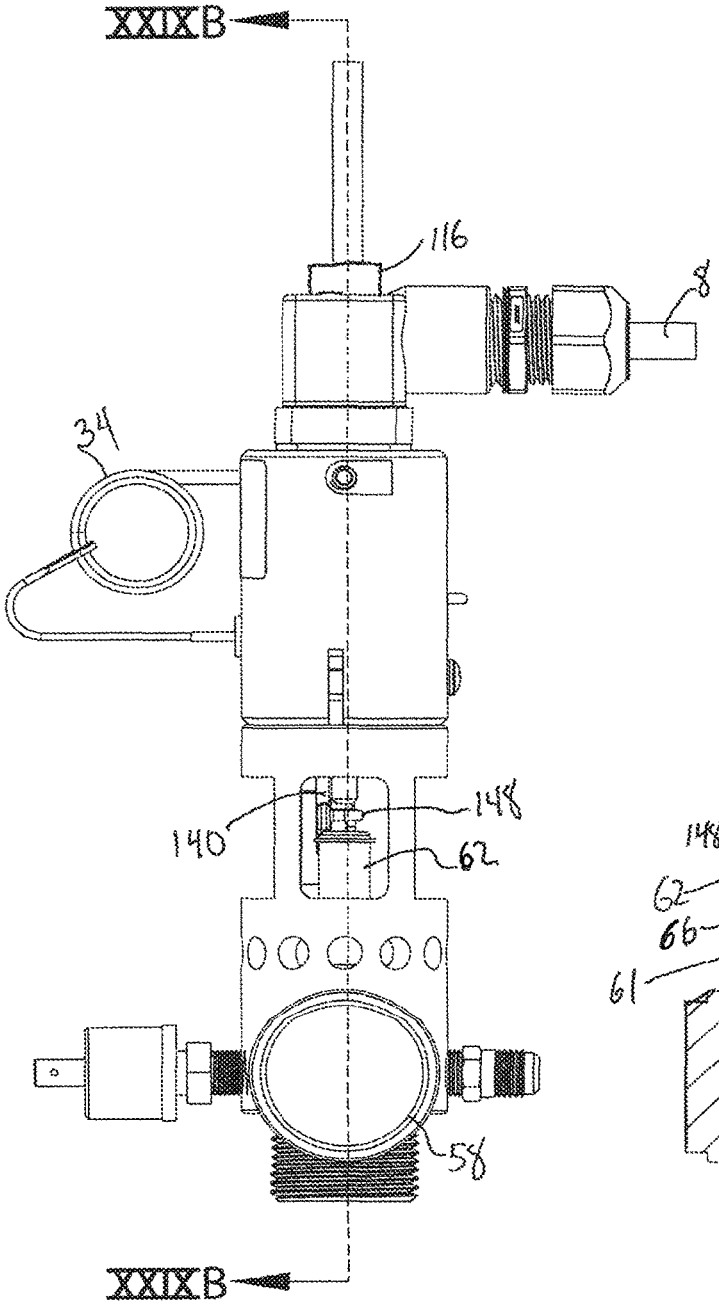
FIG. 29A is a front view of an actuation device in a discharging state with the breakable pin being broken and dislodged due to movement of the actuation lever upon activation from being manually triggered from pulling on the wire cable.
Figure 29B:
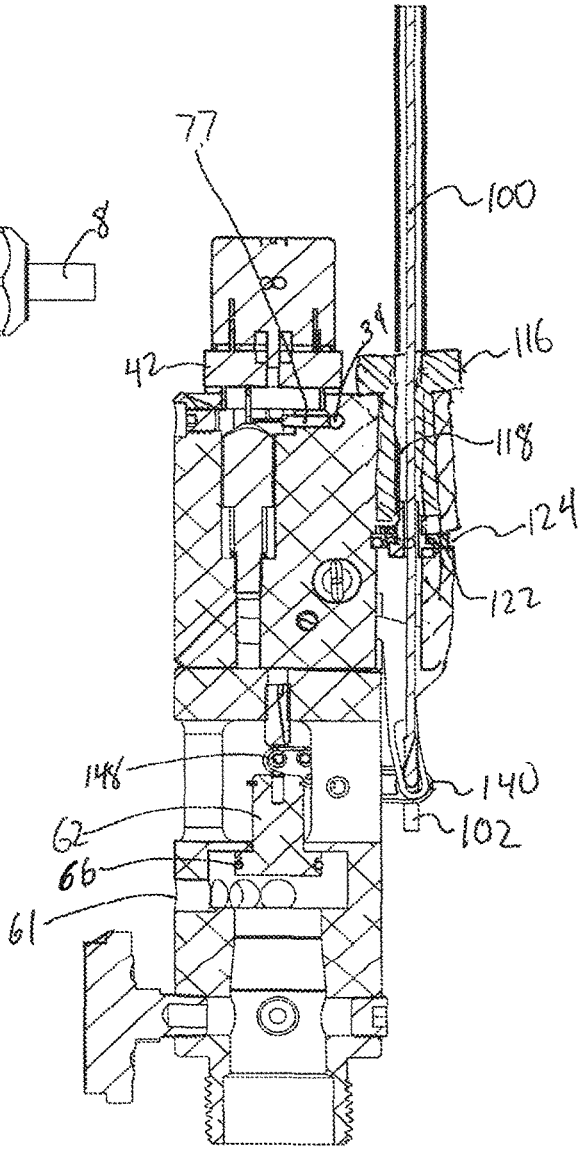
FIG. 29B is a cross sectional view of the activation device in FIG. 29A taken along lines XXIX-XXIX upon activation from being manually triggered by the wire cable.

The control panel 150 may include a manual release 152 configured to manually trigger from the control system 150 the units 30. The control panel 150 may also include a control key 154 that may activate or deactivate the control panel 150 with a lockable key. This allows a control panel 150 to be disabled in certain circumstances, ensures that it cannot be unintentionally deactivated. The control panel may also include system status which may show the status of the overall system, a zone status, which may show the overall status of each zone, an individual unit status which may show the status of each unit 30. A zone 157 is illustrated in FIG. 25 includes multiple units 30. The 444 and five mounting bracket no back peace no scraps 31 difference in paint one for Lou is 33 belonging to portions. You as well. Drop the zone status in unit status is that the zone status would include multiple units 30. The control panel may also include a releasing status in a disablement or supervisory status.

The actuation device 40 includes a safety or lock pin 34 similar to the type found on most portable fire extinguishers today. The lock pin or safety pin 34 is configured with a loop 33 and elongated portion 35 that is inserted into a lock hole 56 on the valve portion 50. A lock retention mechanism or recess 76 which is illustrated as a lock pin securing hole on the actuation portion 70 is also included to ensure the device 30 keeps its locking pin 34 proximate to the unit 30 but not in the lock hole 56 on the valve portion 50, which would render the unit 30 in a safe or inoperable state. The present invention substantially simplifies use of the device as much as possible and makes its operation similar to existing hand held fire extinguishers by making removal and placement of the lock pin 34 similar to the steps required to place hand held fire extinguishers in an operable or inoperable state. Therefore, when installed, the lock pin 34 is removed from the lock hole 56 and placed into the lock retention mechanism 76 on the actuation portion 70 to prepare the actuation device 40 in a ready state where it can discharge its contents. However, the present invention provides a unique lock pin securing mechanism 76 such as the illustrated hole on the actuation portion 70 for receiving the lock pin 34 when it is disengaged from the lock hole 56 on the valve portion 50. As previously stated, one issue with pre-engineered systems is the installers or helpful people replace the lock pin into the valve lock hole 56 which prevents it from firing and the present invention provides a unique apparatus and device that reports back to the control system the status of whether the device is ready to fire or not. Therefore, the present invention includes lock securing mechanisms 76 specifically the lock pin securing hole 79 on the actuation portion 70 into which the lock pin 34 is inserted. The lock pin securing mechanism includes a magnet 78 at one end that insures the pin 34 stays secured in the lock pin securing mechanism 76. As described in further detail below the magnet 78 magnetizes the lock pin 34 which triggers a sensor or switch 77 confirming that the lock pin 34 is secured within the lock securing mechanism 76 on the actuation portion and therefore the device 30 is in an operation or ready state, ready to discharge its contents.

In traditional handheld fire extinguishing units the lock pin 34 secures one of the handles from approaching the other handle and therefore preventing release of the valve 62. In the present invention, the actuation device 40 further includes a lever mechanism 110, which includes an actuation lever 130, an actuation interlink 112, a valve lever 140, and a lock hole 144 on the valve lever 140. It should be noted that while the lock pin retention mechanism 76 is on the actuation portion 70 it could be potentially located in other areas. While the motion of the actuation lever mechanism 110 is further described below, the valve lock hole 56 is defined or passes through the body of the valve portion 50 and is aligned with lock hole 144 on the valve lever 140 in an untriggered state allowing the lock pin 34 to be inserted at any time to put the device in a safe state to allow work on the system 20. The valve lever 140 is, with the safety pin 34 inserted into the aligned lock holes 56, 144 such that the valve lever 140 becomes secured from substantial movement relative to the valve body 60. More specifically the holes 56, 144 allow the safety pin 34 inserted into the lock hole 52, to pass through the valve body 60 and valve lever 140, which immobilizes the valve lever 140, preventing the valve lever 140 from breaking the breakable pin 82, which is commonly a glycerin bulb 84. When removed, the safety pin 34 in the present invention is moved to the lock pin securing mechanism 76 on the actuator 70 and inserted until it touches the magnet 78, which then slightly magnetizes the safety pin 34, causing the sensor 77 to sense the safety pin 34 being securely stored in the storage hole or lock pin securing mechanism 76. The sensor 77 in turn can signal the control panel 150 that the unit 30 is operational. This would remove any fault lights on the control panel 150. The safety pin 34 is formed from carbon steel, allowing it to be magnetized as discussed above. Of note, if the safety pin 34 is removed but not inserted into the storage hole or lock pin securing mechanism 76, the fluid or gas may still be discharged from the associated unit 30 while the sensor 77 may still send a warning to the control panel 150.

In a specific embodiment, the sensor 77 on the actuation portion 90 is a Reed switch so that when the safety pin 34 is fully inserted into the storage hole or aperture, it contacts the magnet 78, is magnetized and the reed switch is triggered, providing feedback to the control panel 150 that the unit 30 is operational as the safety pin 34 has been removed from the lock holes 52, 144 and properly stored in the lock pin security mechanism 76. If the pin 34 is not placed in the second aperture or component, the control system 20 will indicate an installation fault with that specific fire extinguishing unit 30 which will prompt investigation by the supervisor. If the pin 34 is removed from holes 56, 144 but not placed in the lock pin securing mechanism 76, the control system will still indicate fault to the supervisor as a precautionary measure. No matter the placement of the switch, it should be noted that the unit will still discharge in response to elevated temperatures when the glycerin bulb 84 breaks in response to increased temperature. However, if the system 20 includes more than one fire extinguishing unit or device 30 or in some instances more than one fire extinguishing device or unit 30 in a single area it may include a breakable pin 82 which is not a glycerin bulb 84 in place of the glycerin bulb 84, and is not configured to shatter at a specified temperature. In most instances, in a multiple device system, it is not desirable to have one device 30 actuate independent of another device 30, as they are usually sized or placed to work in cooperation and if they do not work in cooperation, such as only one device activating, they may not extinguish the fire, even if the other device later activates. As such a system that contains multiple extinguishers generally will not have a glycerin bulb that allows activation unit by unit in response to a temperature change. Of course a glycerin bulb for independent activation by temperature is still acceptable for a single unit system or a system that has a single unit in widely disbursed areas where only a single unit is designed or desired to be activated in response to a fire condition. Even if there is a fault due the pin 34 not being removed properly, if it has been removed from the lock aperture 56, 144 and not inserted into the lock pin retention mechanism 76, it could be configured to still attempt to fire in response to a specified operating configuration. It should be appreciated that the pin 34 and the determination of proper pin storage could also be utilized to notify the control system 20 of improper installation without necessarily incorporating features of a Reed switch. For example, the pin 34 may include an electrical component, or the second aperture/component may include a mechanical switch that actuates during the insertion of the pin 34. Furthermore, it may include a sensor that detects the lock pin 34 inserted into the valve hold 56.

Figure 15:
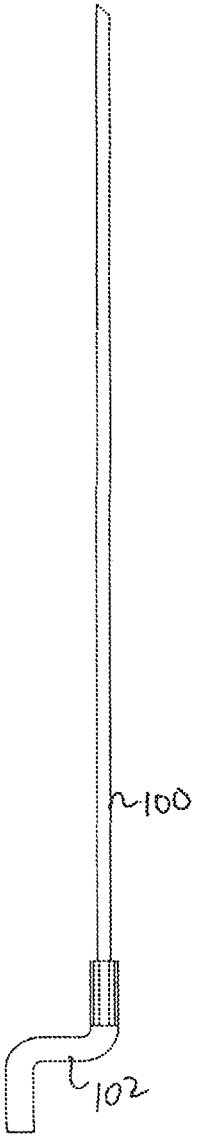
FIG. 15 is a front view of a pull cable with interlink.
Figure 20:
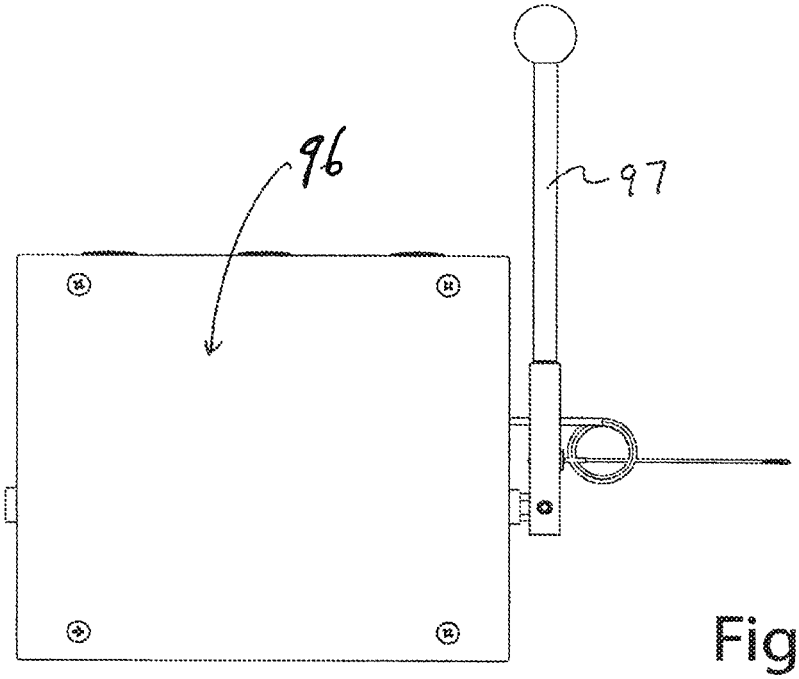
FIG. 20 is front view of a remote manual release box, including the pull lever.
Figure 21:
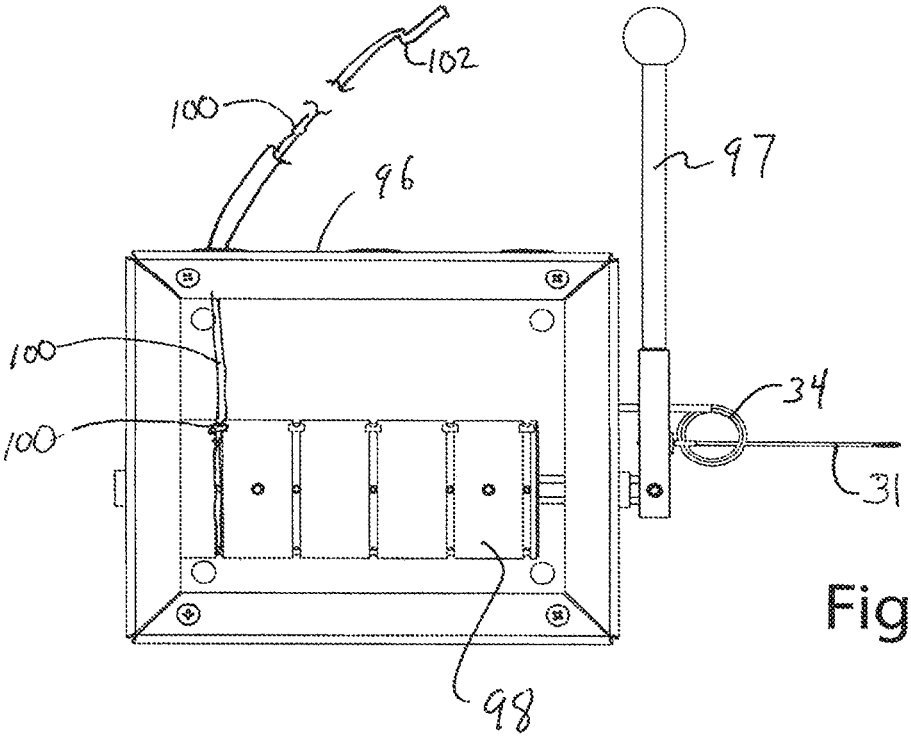
FIG. 21 is a front view of the remove manual release box with the cover being removed to show the cable drum.
Figure 22:
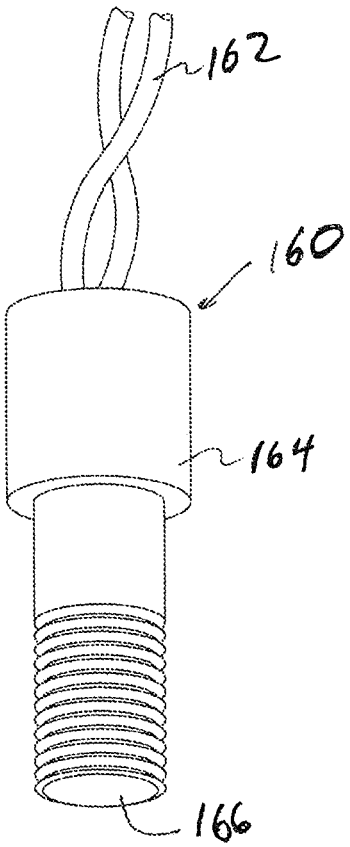
FIG. 22 is a bottom perspective view of a metron actuator in an unfired state.

The actuation device 40 may include a manual triggering mechanism 90, illustrated in the figures as at least one of a pull handle 94, pull loop 92 or pull lever 97. The pull loop 92 may be formed as part of the actuation lever 130 and extends out the opposing side of the actuation lever from a link arm 136. The pull loop 92 allows activation locally at the device so long as the locking pin 34 is removed from the valve locking holes 56, 144. When the pull loop 92 is pulled it rotates the actuation lever 130 including the actuation portion 70, which pivots and in turn rotates the link arm 136 and causes the valve lever 140, coupled to the link arm 136 through the link slot 138 and moves, breaking the breakable pin 82. In some embodiments it may not be desirable to manually engage the device 30 at the device so a remote handle 94 or a pull lever 97 on a manual release or activation box 96 may be desirable. In addition, as illustrated in FIGS. 20 and 21 the manual release box 96 may include a cable drum 98 in which a plurality of cables 100 extending to the actuation device 40 of different extinguishing units 30 may be wound so that single pull of the pull lever 97 may cause the cable drum 98 to rotate and wind up the wire cable 100 which pulls on the interlink portion 102 secured as the interlink between the actuation lever 130 and the valve lever 140. The wire cable 100 may be inserted in a conduit or other outer jacket 93 which will engage the actuation device 40. The cable 100 may be seen in FIG. 15, extending downward and ending in a metal offset portion that acts as the activation interlink 102, which ties the actuation lever 130 and valve lever 140 together. It should also be noted that the valve lever 140 includes a loop 48 on the valve lever 140, which surrounds the glycerin bulb 84 or breakable pin 82. As the valve lever 140 pivots during activation, either with the manual pull or the triggered actuator 160, through the control panel or other mechanism for activation, the triggered actuator 160 applies force to the actuation lever 130, which in turn applies force to the valve lever 140 and the loop 148 pulls and pivots, and breaks the breakable pin 82. For all discharges of the contents from the unit 30, the breakable pin 82 must break, allowing the valve 62 to extend upward away from the valve seat or support 64, disengaging the seal 66 as illustrated in figures causing the contents to exit through the discharge nozzles 61. The discharge nozzles 61 as illustrated are only exemplary and can be configured in multiple ways to direct the contents as desired upon activation. It should be noted that it has been found that a combination of twist and pull or push on the breakable pin 82 reduces the force required to be applied by the lever mechanism 110 as compared to just pushing or pulling on the breakable pin 84 or only rotating. If the breakable pin 82 is a glycerin bulb 84, it may be configured to break at different actuation temperatures, such as to meet specific requirements. For example, the bulb 84 may break at 135, 155, or 175 degrees Fahrenheit, or any other specified temperature As illustrated in FIG. 16 through 19 a cable stop 116 is provided is extremely helpful during setup. More specifically the wire cable 100 may be run to the manual release box 96 as illustrated in FIGS. 20 and 21 from the units 30. The wire cable may be adjusted and tightened using the set screw 122 secure the wire cable 100 and the wire cable recess 118. The cable stop 116 is placed in the cable cavity 106 as illustrated in the cross-sectional figures. The cable cavity 106 receives the elongated end of the cable stop 116. After tension of the wire cable the cable stop is further pressed down into the cable cavity 106 and then a clip 108 is inserted in the side slot 73 on the actuator body 72.

The system 20 generally provides a plurality of fire extinguishing units 30 configured to be arranged in a high risk area, such as an engine, server room, or control room. The fire extinguishing units 30 are spaced apart with each respective discharge nozzle(s) or part(s) 61 oriented such that a concerted discharge sufficiently covers the entire at risk area. Each fire extinguishing unit 40 may be in communication with a control panel 150, sensors 180, and/or the other units 40. In addition to the control panel 150 activating the actuation devices 40 in response to input from sensors 180, the control panel 150 may include programming that when one fire extinguisher unit 40 discharges, either manually or via a temperature threshold breaking a glycerin bulb 84, the control panel 150 may sense such discharge and a command may be sent to the nearby fire extinguishing units 40 to discharge their contents. More specifically, if one unit 140 discharges, the control unit may automatically discharges the other units 40. The sensors 180 can also include conventional fire detecting units such as smoke alarms and heat monitors or any other device in communication with the control panel to actuate the device 40 through the triggered actuator 160 such as the illustrated metron actuator 164.

The manual actuators, such as the pull loop 92, pull cable 94 are particularly useful if there is a small localized fire risk that doesn't require the discharge from multiple devices, or it can be set off by a person before the control panel 150 has even sensed through the sensors 180 that a fire is present, or before the heat reaches a temperature that breaks the glycerin bulb 84, if so equipped.

Figure 18:
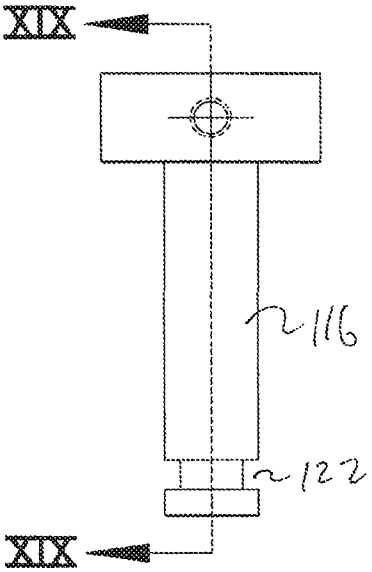
FIG. 18 is a front view of the cable stop in FIG. 16.
Figure 19:
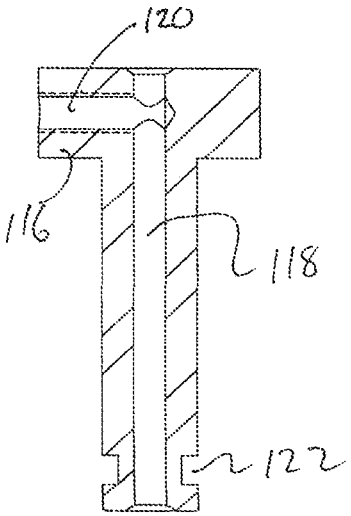
FIG. 19 is a cross sectional view of the cable stop in FIG. 18 along lines XIX-A.
Figure 30A:
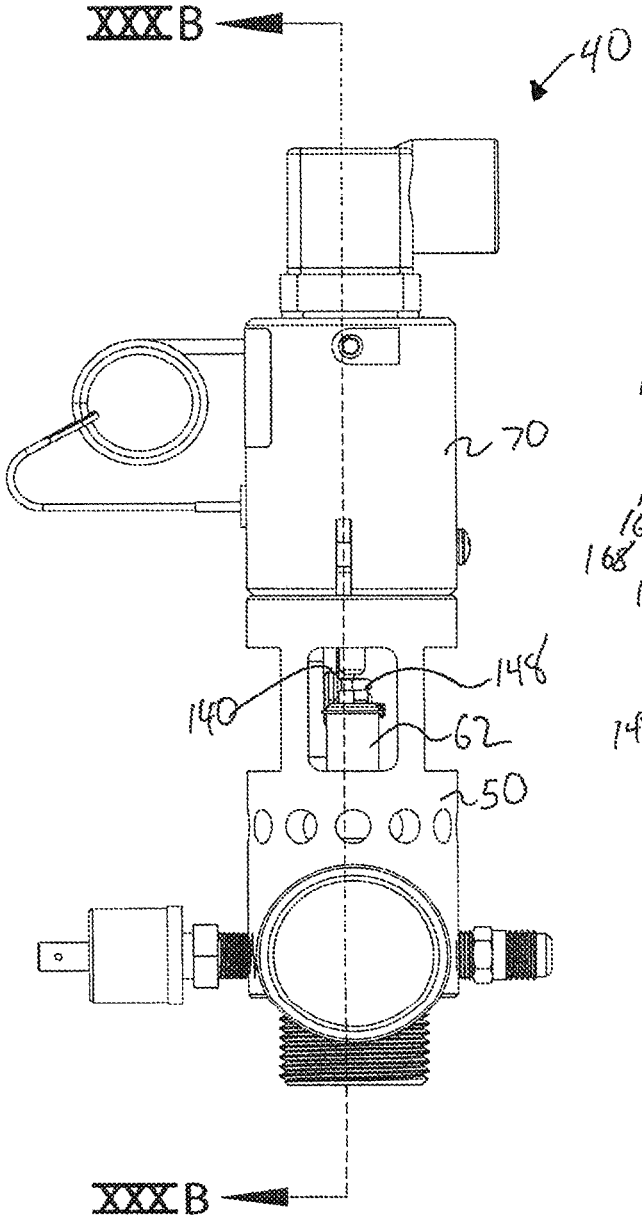
FIG. 30A is a front view of an actuation device in a discharging state with the breakable pin being broken and dislodged due to movement of the actuation lever upon activation of the triggered actuator.
Figure 30B:
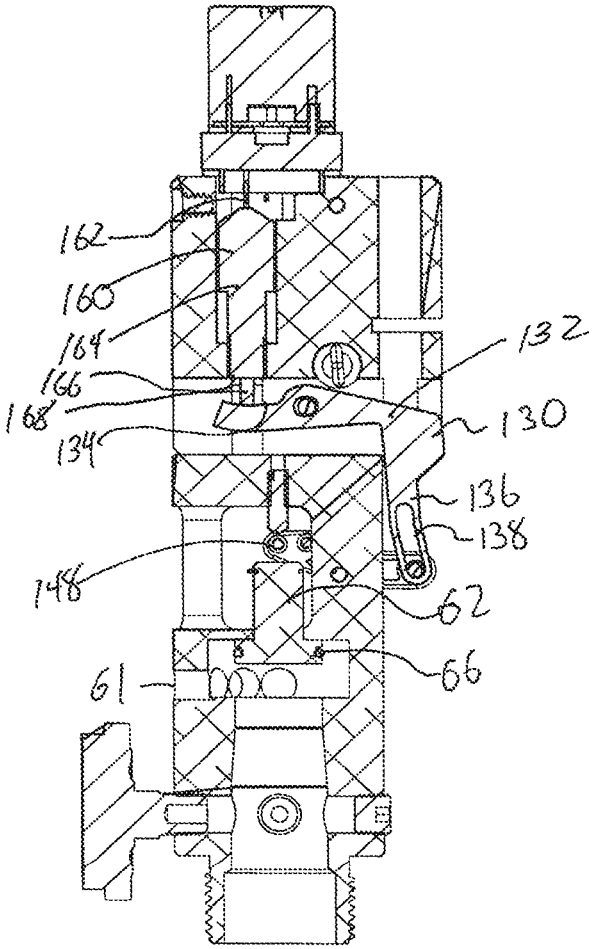
FIG. 30B is a cross sectional view of the activation device in FIG. 29B taken along lines XXX-XXX upon activation from being triggered by the triggered actuator.

It should be noted that as mentioned above there is a link slot 138 in the actuation lever 130, specifically the link arm 136 which allows the interlink 102 when the manual activation 92, 94 or 97 is pulled to slide freely relative to the actuation lever 130, but also move the valve lever 140. The activation lever 130 includes the activation arm at 132 and the link arm the activation arm 132 includes an activation surface 130 136 extending therefrom. For against which forces applied such as when the triggered actuator 160 extends the pin 168. The link arm includes a pivot hole 137 through which a faster may be applied with the activation lever 130 pivoting or rotating about the pivot hole 137. At the same time, the interlink 102, 104 when the actuation lever 130 is pivoted in response to the triggered actuator 160 being activated, the interlink 102, 104 forces the valve lever 140 to move with the actuation lever 130, thereby breaking the breakable pin 82. The triggered actuator 160 can also include electric actuators, such as the metron actuator 164 illustrated throughout the figures, wherein the control panel 150 may automatically, activate the triggered actuator 160, or in rare instances a supervisor at the control panel 150 can manually activate the triggered actuators 160 and thus change the state of the valves 62 from any remote location by operation of commands sent through the control panel 150. As mentioned above, these commands could require all or only certain fire extinguishing units 40 to discharge, although in most instances, it is expected that all will be discharged together to meet code requirements. A metron actuator 164 is illustrated in FIGS. 18 and 30 as being discharged, with the plunger or piston 168 extending therefrom, pierced through the base 166.

In one exemplary embodiment, as best illustrated in FIGS. 1-4, the actuation device 40 of the fire extinguishing unit 30, specifically the valve portion 50 includes tank connector 52, such as the illustrated thread in mechanical engagement with the tank 32. The actuation device 40 is generally illustrated as oblong cylindrically-shape that extends along an axis; however, the actuation device 40 could be configured in any feasible manner allowing operation of all its parts. The actuation device 40 includes at least two actuators that can be disposed thereon or housed therein. In operation, the control panel 150 triggers the triggered actuator 160, such as the illustrated metron actuator 164 and opens the valve 63 by the plunger or pin 108 extending and forcing the actuation lever 130 to pivot, in turn making the valve lever 140 slide or be pulled outward from the valve portion and break the breakable pin 82. It should be noted that in the illustrated embodiment, the valve lever 140 is not tied to or coupled to the valve portion 50, but instead resides in a slot 63 on the valve portion 50 allowing free movement, except for when the pin 32 is placed through the lock holes 56, 144 on the valve body 60 and the valve lever 140, respectively. This slot 63 on the valve body 160 and the free movement may be best seen in the cross-sectional views in the figures.

Figure 23:
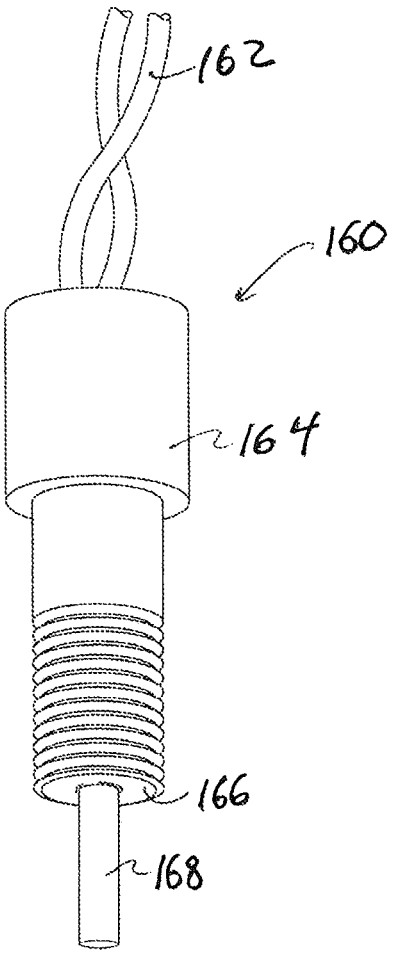
FIG. 23 is a bottom perspective view of a metron actuator in a fired state.
Figure 24:
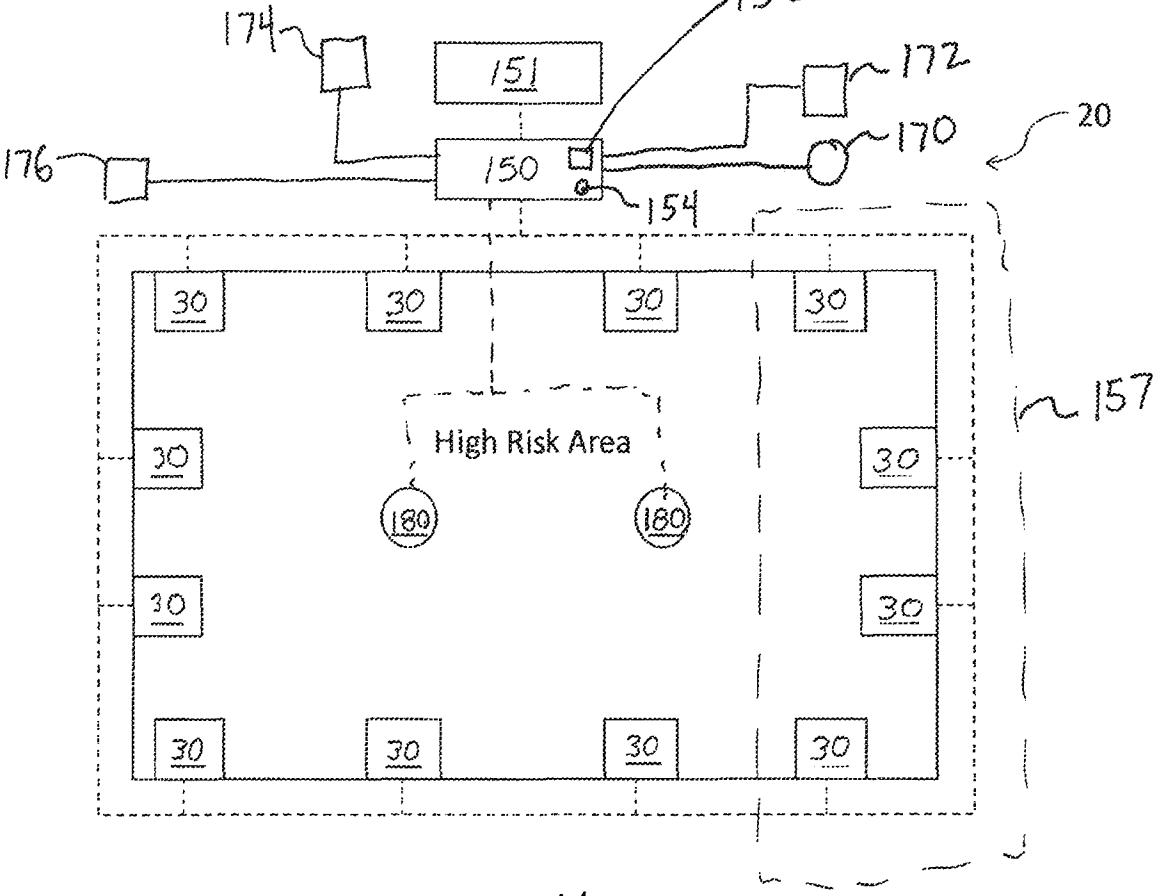
FIG. 24 is a schematic diagram of a fire suppression system in an exemplary facility.

As discussed above a triggered actuator 160, such as the illustrated metron actuator 104 is an electric actuator fired remotely or automatically, by an electrical charge. While the electrical charge may be provided by a control panel 150 through the connectors 162, the control panel 150 may be in wireless communication with the actuator 40 and as such need an additional electrical source to provide the charges to fire the triggered actuator 160. In operation, the metron actuator 104 fires by igniting black powder, not illustrated, as a one-time activation, creating expanding gas not the piston or plunger 168 that pierces the bottom 166 (illustrated as activated in FIG. 23). It should be noted that the metron actuator 164 is not reusable and the piston once extended stays extended. Of course, in the event that the control wires are damaged and the control panel cannot fire the metron actuator, the glycerin bulb 84 or manual triggering mechanisms 80 provide a reliable non-fail mechanism as it will break the bulb 84 by being exposed to high enough temperatures or upon someone triggering the device. It should be noted, if there is a fault in the electrical communication, the system may be configured to provide a feedback, such as a fault sound or light on the control panel, extinguishing unit 30, and/or other locations. In one specific embodiment, the firing of the metron actuator 104 advances a plunger or pin 168 that exerts hammering pressure on an actuation lever 130, pivotally pulling the valve lever 140 outward and breaking the breakable pin 82 thus changing states of the valve 62 to discharge the contents in the tank 32. In each method of activation, the breakable pin 82 is broken, allowing the valve 62 to extend upward and thereby discharge the contents of the tank 32.

Figure 13:
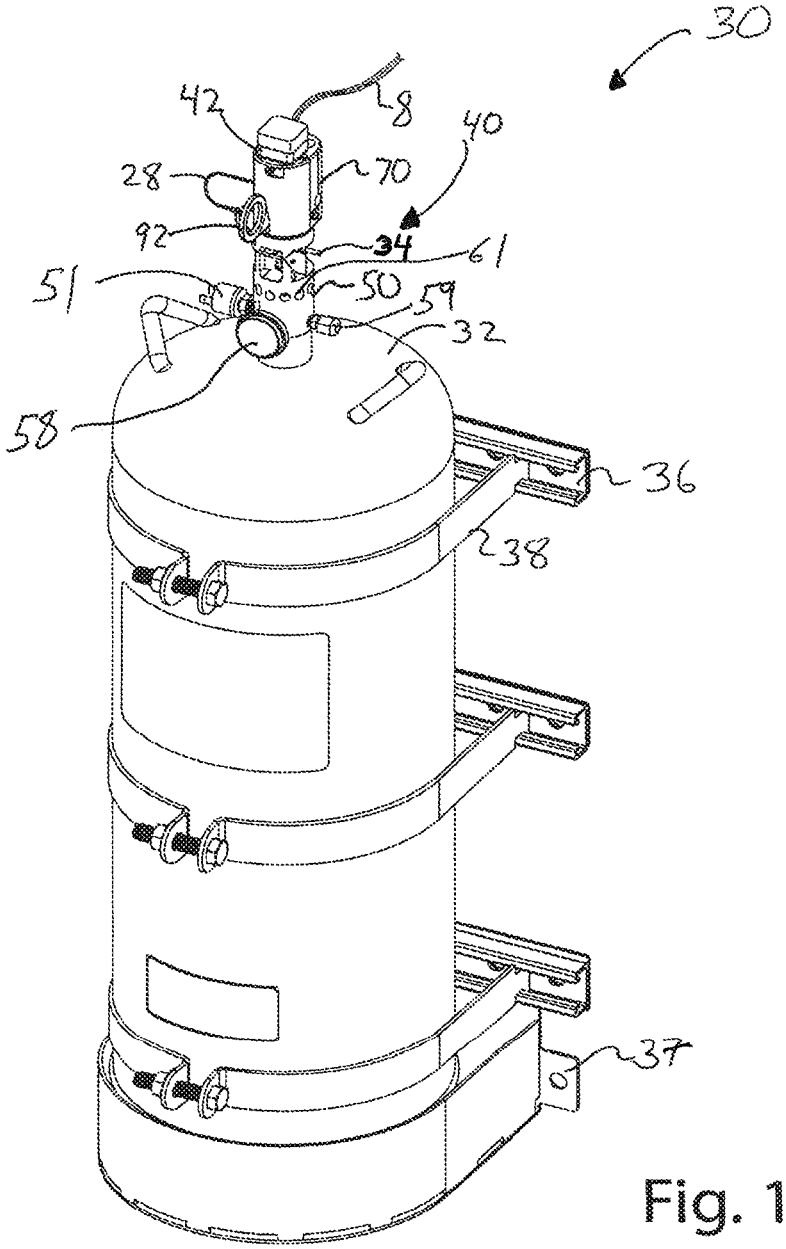
FIG. 13 is a perspective view of an actuation device including the tank and support bracket.
Figure 14:
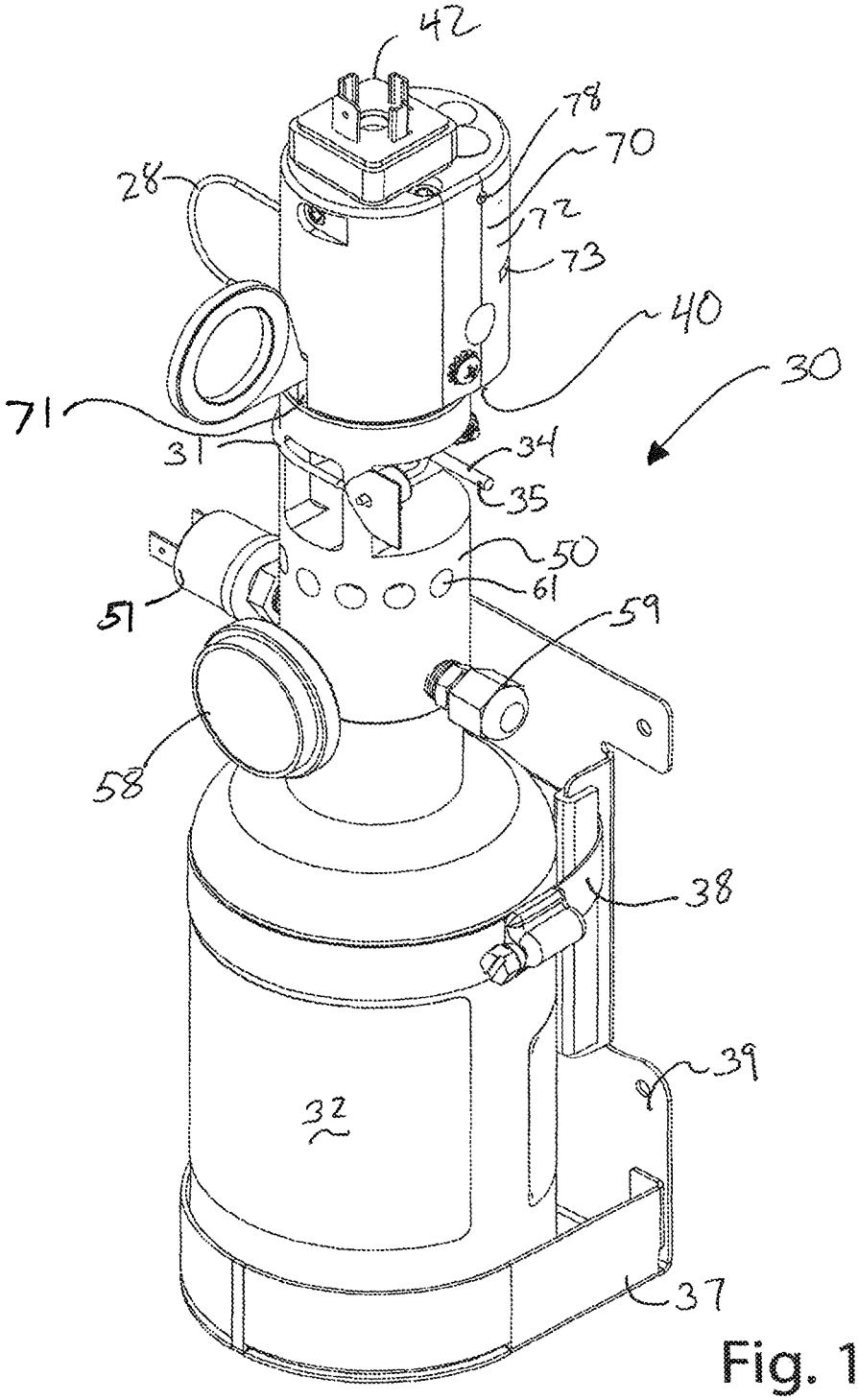
FIG. 14 is a perspective view of an actuation device with tank and support bracket.
Figure 16:
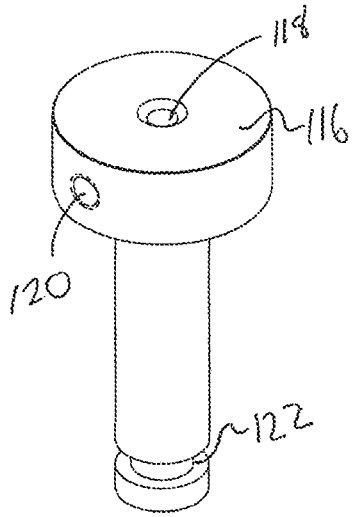
FIG. 16 is perspective view of a cable stop configured to be inserted into the cable cavity and secured to a wire cable.
Figure 17:
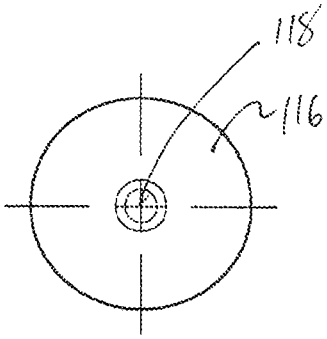
FIG. 17 is a top view of the cable stop in FIG. 16.

Each respective fire extinguishing unit 30 may be mounted in a variety of ways, placed on a shelf, or in a wall, placed on a rack within the room or any other method. In the illustrated embodiment, the unit 30 is a smaller unit of about 375 cubic feet and is provided with a mounting bracket 36. The mounting bracket 36 can be seen best in FIGS. 13 and 14 and provides a base member 37, a pair of straps 38 and a back piece 39 for mounting to the wall around an at risk area. In FIG. 13 multiple straps 38 and mounting brackets 36 are used along with a base member 37 two mounted to a wall. The base member 37 supports the weight while it is being strapped in with the straps 38. As further illustrated in FIG. 14 in place of the mounting brackets 36 or in addition to a back piece 39 may be used with a strap 38 extending through. The base member 37 may be integral with the back piece 39. Thus mounting the units 30 will be based on the requirements of coverage, a larger area requiring more coverage. The control system 150 and mounting brackets 36 are configured so that the system 20 can be installed without requiring substantial interference to an existing structure, unlike a sprinkler system which oftentimes requires substantial renovation, or engineered systems.

In some embodiments the electrical connection may include a Deutsches Institut für Normung (DIN) connector 74 or any other type of easy plug connector. The DIN connector 74 allows communication with the CPU and permits transfer of data regarding individual fire extinguishing units 30 to a user/supervisor or control panel 150. Of course, the illustrated connection for firing the triggered actuator 160 may be combined with the DIN feedback. The DIN 57 also allows each fire suppression system 20 to remotely activate the units 30, locally, or in concert. As such, the combination of actuators 40 in each fire extinguishing unit 30, and the ability to remotely and locally fire specific fire extinguishing units 30 in response to environmental data allow a dynamic response to fire risks of various location and magnitude. As stated above, the electrical connection 74 also transmits data regarding whether the fire extinguishing units 30 have been properly installed. The electrical connection 74 could further include wireless technology. For example, the control panel may indicate to the supervisor if a fire extinguishing unit 30 was installed without removing the pin 34. It should also be appreciated that the CPU could be associated with wireless transmission of information, such that the supervisor need not be on site. As just one exemplary example, the supervisor may get notifications on his or her mobile device or a computer from off-site operations headquarters. To this extent, the system 20 provides an electric connection means that may be integrated into any existing control system without requiring the effort associated with having to configure an entirely new system which often requires the installation of complex and expensive wires and electrical components.

Figure 31:
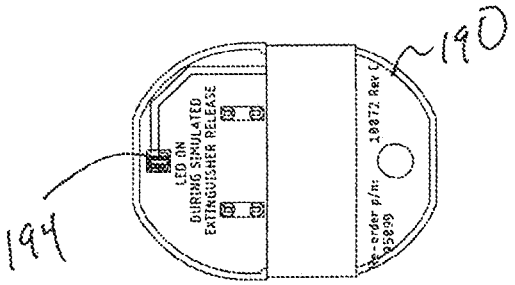
FIG. 31 is a top view of the keychain tester.
Figure 32:
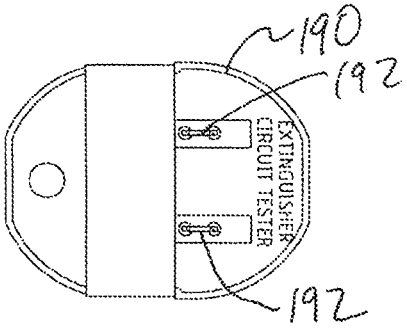
FIG. 32 is a bottom view of the keychain tester in FIG. 31.
Figure 33:
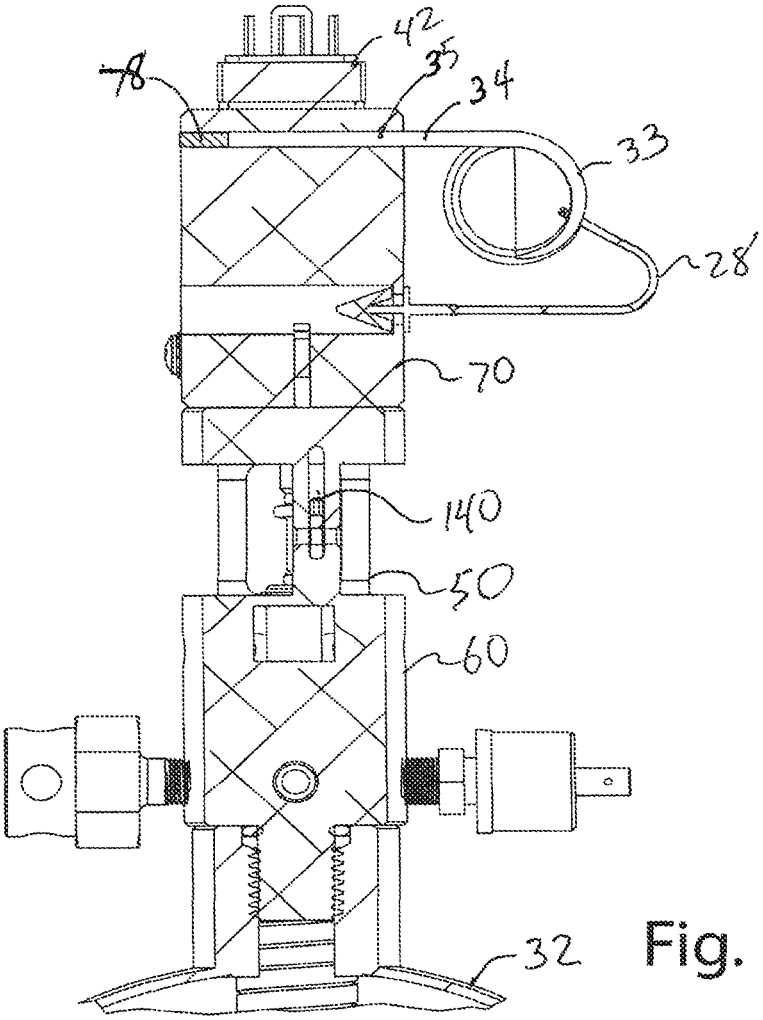
FIG. 33 is an enlarged cross-sectional view showing the locking pin in the lock retention mechanism on the activator portion and engaging the magnet.
Figure 34:
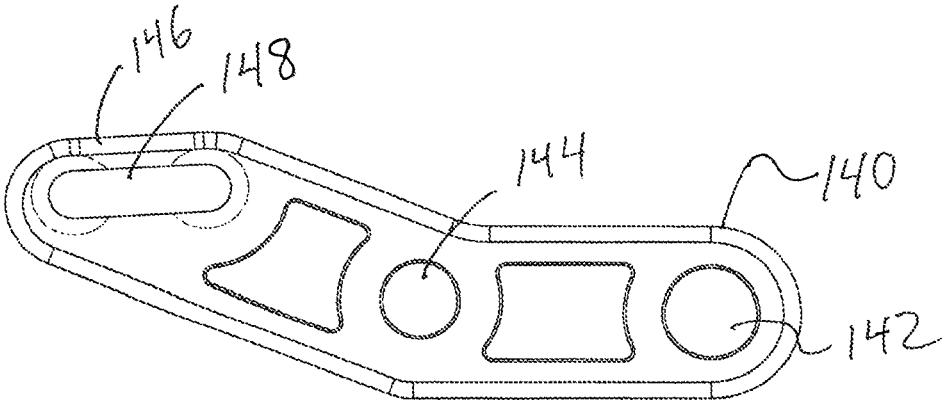
FIG. 34 is a front view of the valve lever.
Figure 35:
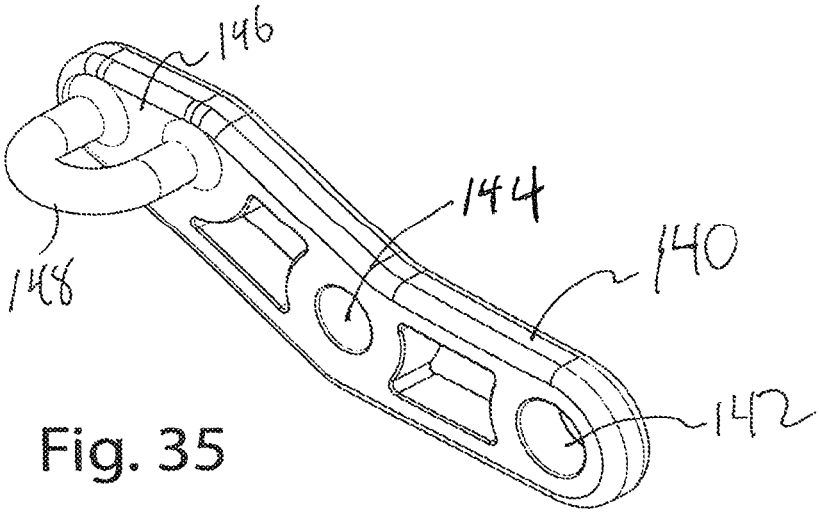
FIG. 35 is a top view of the valve lever.
Figure 36A:
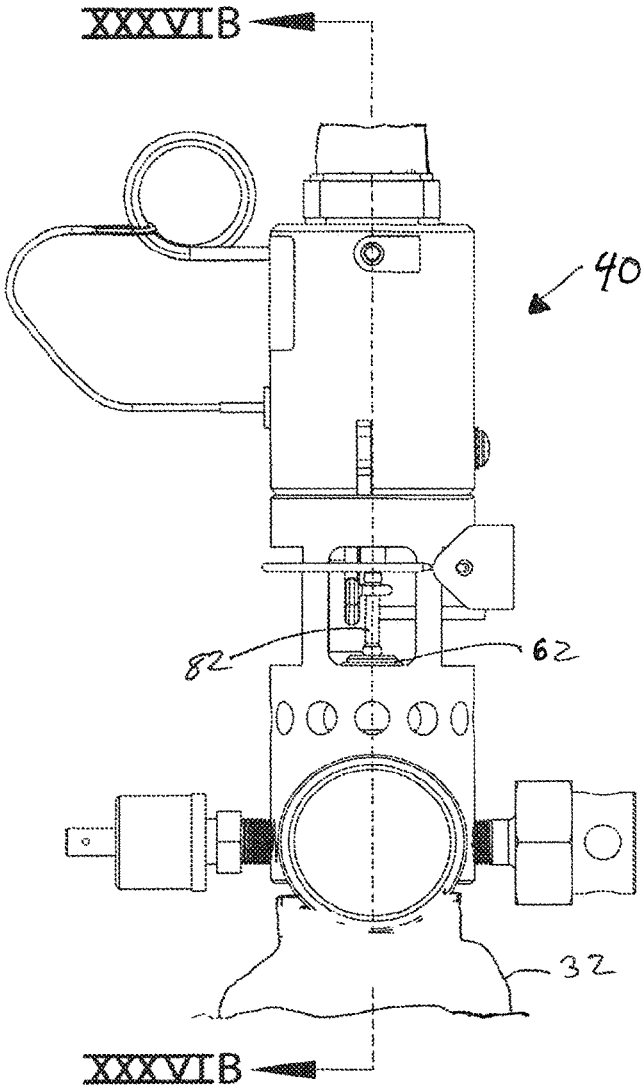
FIG. 36A is a front view of the actuation device in a ready state with the lock pin secured in the lock pin retention mechanism.
Figure 36B:
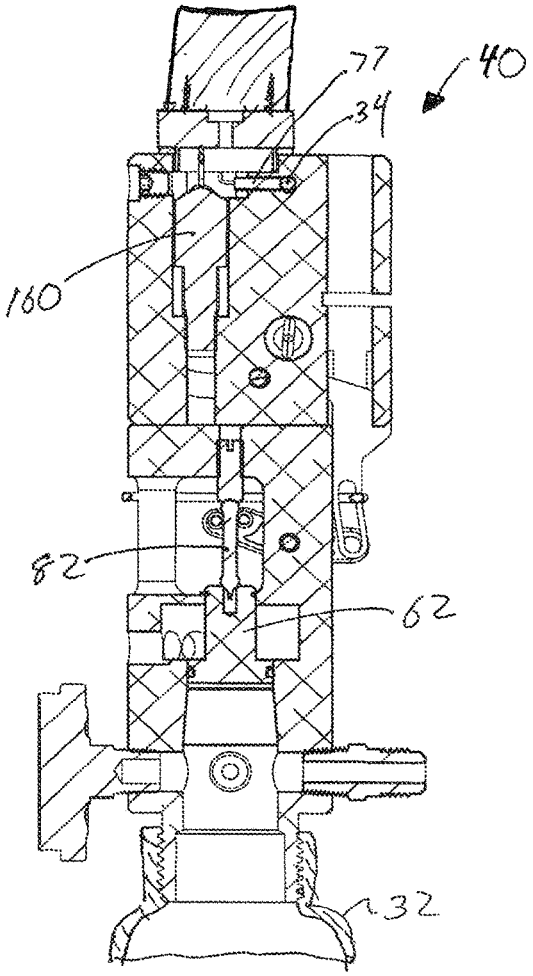
FIG. 36B is a cross sectional view of the actuation device taken along lines XXXVI-XXXVI in FIG. 36A, in a ready state.

As the present invention uses a triggered actuator 160 that may be a single use trigger actuator, such as a metron actuator 164, the system 20 includes a unique test device 190 as illustrated in FIGS. 31 and 32. After installation of the units 30 and connecting of the control panel 152 to the electrical communication lines, such as the illustrated wires and plugs 8 in the figures, but before plugging in electrical connection 8 to the connector 42 on the actuation device 40, the tester 190 is plugged in to a connector on the electrical connection 8. The installer would then test the system 20 such as manual releasing the manual release 152 on the control panel 150, running through testing the sensors 180, such as smoke or heat detectors, and each time looking for the LEDS 194 on the tester 190 actuate at each unit 30. The tester 190 or test device 190 will be plugged into the electrical communication 8 via the pins 194 and the actuation device 40 will not have the electrical connector 42 coupled to the electrical connector 8 during testing. If a proper signal is received from the control panel 150, the test device 190 will have the LEDS light up 194 as the pins 192 on the test device 190 are in electrical communication with the control panel 150. While the tester 190 in FIGS. 31 and 32 is a simple led on or led off device, more complicated testers of course could be added to test various additional communications. However much of the other testing may be done at the control panel 150 as the test device 190 is provided to prevent accidental triggering of the triggered actuator 160, specifically if the triggered actuator 160 is one time use metron actuator 164.

Many modifications and variations of the present disclosure are possible in light of the above teachings and may be practiced otherwise than as specifically described while within the scope of the invention.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Many other embodiments may be apparent to those of skill in the art upon reviewing the disclosure. Other embodiments may be used and derived from the disclosure, such that a structural substitution, logical substitution, or another change may be made without departing from the scope of the disclosure. Accordingly, the disclosure is to be regarded as illustrative rather than restrictive.

Certain features are, for clarity, described herein in the context of separate embodiments, may also be provided in combination in a single embodiment. Conversely, various features that are, for brevity, described in the context of a single embodiment, may also be provided separately or in any sub combination. Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

What is claimed is:

1. A pre-engineered fire suppression system configured to release pressurized material to extinguish fires, said pre-engineered fire suppression system comprising:

a control panel;

a sensor capable of detecting a fire condition and in communication with said control panel;

at least one fire extinguishing unit in communication with said control panel and including an activation device coupled to a tank capable of holding the pressurized material and wherein said activation device includes a first triggering mechanism capable of being triggered by said control panel and a second manual triggering mechanism;

a lock pin and a lock pin recess on said activation device and wherein when said lock pin is inserted into said lock pin recess, said first and second triggering mechanisms are immobilized; and a lock pin retention mechanism including a lock pin status sensor in communication with said control panel.

2. The pre-engineered fire suppression system of claim 1 wherein said activation device includes a valve body portion having said lock pin receiving recess, and an activation portion, and wherein said activation device also includes said lock pin retention mechanism.

3. The pre-engineered fire suppression system of claim 2 wherein said lock pin recess on said valve portion upon receiving said lock pin is configured to prevent releasing of the pressurized material from said tank.

4. The pre-engineered fire suppression system of claim 1 wherein said lock pin retention mechanism includes a magnet configured to magnetize said lock pin when said lock pin is received in said lock pin retention mechanism.

5. The pre-engineered fire suppression system of claim 4 wherein said lock pin status sensor is a reed switch, triggered when said lock pin is magnetized by said magnet.

6. The pre-engineered fire suppression system of claim 4 wherein said magnet secures said lock pin in said recess and lock pin status sensor communicates a ready and active signal upon stowing of said lock pin in said lock pin retention mechanism to said control panel.

7. The pre-engineered fire suppression system of claim 4 wherein said lock pin status sensor communicates a fault signal to said control panel when no lock pin is stowed in said lock pin retention mechanism.

8. The pre-engineered fire suppression system of claim 1, further including a third triggering mechanism, in addition to the frst and second triggering mechanisms.

9. The pre-engineered fire suppression system of claim 8 wherein said third release mechanism is a glycerin bulb configured to shatter upon reaching a set temperature condition.

10. The pre-engineered fire suppression system of claim 1 further including an activation portion and a valve portion and a lever mechanism extending between said activation portion and said valve portion and wherein said valve portion includes a valve body and a valve movable between an open position and a closed position relative to said valve body.

11. The pre-engineered fire suppression system of claim 10 wherein said lever mechanism includes a valve lever coupled to an actuation lever.

12. The pre-engineered fire suppression system of claim 11 wherein said actuation lever is coupled to said second manual triggering mechanism.

13. The pre-engineered fire suppression system of claim 12 wherein said second manual triggering mechanism is a pull loop on said actuation lever.

14. The pre-engineered fire suppression system of claim 12 wherein said second manual triggering mechanism is a pull cable coupled to said actuation lever.

15. The pre-engineered fire suppression system of claim 14 wherein said activation portion includes an activation body having a recess configured to hold an end of said pull cable.

16. The pre-engineered fire suppression system of claim 15 wherein said first triggering mechanism is a metron actuator.

17. The pre-engineered fire suppression system of claim 16 wherein said metron actuator includes an extendable pin and a base and when triggered said extendable pin pierces said base and applies a force to said actuation arm on said actuation lever, which in turn applies a force to said valve lever breaking said breakable pin.

18. The pre-engineered fire suppression system of claim 10 wherein said valve lever is constrained to movement substantially within a plane by a slot in said valve body.

19. The pre-engineered fire suppression system of claim 18 wherein said valve is held in a closed position by a breakable pin held in compression between by said valve body.

20. The pre-engineered fire suppression system of claim 19 wherein said breakable pin is held in compression between a threaded adjustment and said valve.

21. The pre-engineered fire suppression system of claim 19 wherein said valve lever is coupled to said breakable pin.

22. The pre-engineered fire suppression system of claim 21 wherein said valve lever is coupled to said breakable pin with a loop.

23. The pre-engineered fire suppression system of claim 21 wherein said valve lever includes an interlink hole and a lock pin hole between said interlink hole and said loop.

24. The pre-engineered fire suppression system of claim 23 wherein said actuation lever includes an activation arm and a link arm and wherein said link arm includes a link slot and said valve lever is coupled to said link arm to allow said valve lever to have a limited amount of movement relative to said link arm on said actuation lever.

25. The pre-engineered fire suppression system of claim 24 wherein said loop pivots on said breakable pin until said breakable pin breaks when said actuation lever exerts a force on said valve lever.

26. The pre-engineered fire suppression system of claim 24 wherein said actuation lever is substantially constrained to planer movement by a slot in said activation portion.

27. The pre-engineered fire suppression system of claim 1 wherein said sensor is a smoke detector and said control panel is in electrical communication with a plug on said actuation device of said fire extinguishing unit.

28. The pre-engineered fire suppression system of claim 1 further including a test device to test communication of said at least one fire extinguishing unit with said control panel.

29. A pre-engineered fire suppression system configured to release pressurized material to extinguish fires, said pre-engineered fire suppression system comprising:

a control panel;

a sensor capable of detecting a fire condition and in communication with said control panel;

at least one fire extinguishing unit in communication with said control panel and including an activation device coupled to a tank capable of holding the pressurized material and wherein said activation device includes a first triggering mechanism capable of being triggered by said control panel and a second manual triggering mechanism;

a lock pin status sensor in communication with said control panel;

a breakable pin held in compression and wherein said breakable pin is configured to be broken upon said first triggering mechanism being triggered; and an activation portion and a valve portion and a lever mechanism extending between said activation portion and said valve portion, wherein said lever mechanism includes a valve lever coupled to an actuation lever, and wherein said valve lever includes a valve lever hole capable of being aligned with a lock pin receiving recess on said valve portion, and the lock pin, and wherein when a lock pin is placed in said aligned lock pin receiving recess and said valve lever hole said fire extinguishing unit is placed in a safe state.

30. The pre-engineered fire suppression system of claim 29 wherein said valve lever is constrained to movement substantially within a plane by a slot in said valve body and said actuation lever is constrained to movement substantially within said plane by a slot in said actuation portion.

31. The pre-engineered fire suppression system of claim 29 wherein said valve portion is held in a closed position by said breakable pin held in compression between by said valve portion and wherein said valve lever is coupled to said breakable pin with a loop at least partially encircling said breakable pin.

32. The pre-engineered fire suppression system of claim 31 wherein said valve lever includes an interlink hole and a lock pin hole between said interlink hole and said loop and wherein said actuation lever includes an activation arm and a link arm and wherein said link arm includes a link slot and said valve lever is coupled to said link arm with an interlink to allow said valve lever to have a limited amount of movement relative to said link arm on said actuation lever.

* * * * *